US005810494A

United States Patent [19]

Menard et al.

[11] Patent Number: 5,810,494

[45] Date of Patent: Sep. 22, 1998

[54] APPARATUS FOR WORKING ON SHEETS OF SHEET MATERIAL AND SHEET MATERIAL FOR USE THEREWITH

[75] Inventors: Alan W. Menard, Bolton; Robert V. DeMartino, West Hartford; John E. Markowski, III, Berlin; Nabil Mishriki, Portland; Ronald G. Goulet, Hebron; William J. Tortora, Willington, all of Conn.

[73] Assignee: Gerber Systems Corporation, South Windsor, Conn.

[21] Appl. No.: 709,261

[22] Filed: Sep. 6, 1996

[51] Int. Cl.[6] ..... B41J 15/00

[52] U.S. Cl. ..... 400/634; 400/616; 400/616.3; 400/611

[58] Field of Search ..... 400/616, 616.1, 400/616.2, 616.3, 611, 634

[56] References Cited

U.S. PATENT DOCUMENTS

| | | | |
|---|---|---|---|
| 4,545,695 | 10/1985 | Agata | 400/616 |
| 4,688,957 | 8/1987 | Prevignano | 400/616 |
| 4,867,363 | 9/1989 | Wood et al. | 400/616.3 |
| 5,160,938 | 11/1992 | Fargo et al. | 400/279 |
| 5,551,786 | 9/1996 | Webster et al. | 400/616.3 |
| 5,619,246 | 4/1997 | Straayer et al. | 347/262 |

*Primary Examiner*—John S. Hilten
*Attorney, Agent, or Firm*—McCormick, Paulding & Huber

[57] ABSTRACT

An apparatus for printing, cutting or otherwise working sheets of sheet material has a friction sheet advance mechanism and a sheet loading mechanism in advance of the feed mechanism having rows of sprocket pins cooperating with complementary rows of sprocket holes in a sheet to assure accurate insertion of a sheet into the sheet advance mechanism and subsequent accurate movement of the sheet through the advance mechanism and past a work station. A photosensor carried by the work head of the apparatus senses one side edge of the sheet as a reference for laterally positioning the work process relative to the sheet, and a transversely extending index edge of an index hole in the proof sheet is detected and used as a reference for the longitudinal positioning of the work process relative to the sheet. When working on both faces of the sheet, the same reference edges are detected and used as references for the work process on the second face as are detected and used as references for the work process on the first face so as to avoid registration errors between the two work processes.

37 Claims, 9 Drawing Sheets

APPARATUS FOR WORKING ON SHEETS OF SHEET MATERIAL AND SHEET MATERIAL FOR USE THEREWITH

FIELD OF THE INVENTION

This invention relates broadly to apparatus for printing onto, cutting or otherwise working on sheets of sheet material and using a friction sheet advance mechanism for moving sheets past a work station, and deals more specifically with improvements in such an apparatus, and in associated configurations of sheets of material for use with the apparatus, to enhance reliable and uniform introduction of sheets into the apparatus so as to reduce printing, cutting or other inaccuracies in the work process carried out by the apparatus.

In an exemplary application of the invention described in detail herein, the invention relates, in the printing art, to the field of generating offset printing plates through the exposure of photosensitive printing plate media by a light beam raster scanned over the media and modulated by image (pixel) data supplied by a computerized raster image processing system; and deals more particularly with an apparatus and related configured proofing sheets for proofing the acceptability of the image data prior to the use of that data to expose a media sheet.

BACKGROUND OF THE INVENTION

In the present state of printing technology, it is now well known to make printing plates for use with offset printing presses by using sheets of photosensitive media which are exposed in a photoplotter mechanism wherein a light beam, generally a laser beam, is raster scanned over the surface of the media and modulated by image data from a raster image processing system to create a latent image on the involved surface of the media, the media sheet then being suitability developed to produce the final printing surface of the plate. Various different types of plotters may be used for exposure of the media sheets and advantageously the plotter may be an internal drum type plotter such as shown, for example, in U.S. Pat. No. 5,291,392.

If an error exists in the image data, it may not become evident until after the data is used to fully expose a media sheet, the sheet is developed into a finished printing plate, the plate is installed onto a press and the press is operated to produce a print for inspection. This is a lengthy and expensive process and calls for some way of checking the accuracy of the image data at an early pre-press stage by a faster and less expensive procedure.

Also, in the manufacture of books, magazines, newspapers and the like, printing plates are customarily made in matched pairs with one plate of a pair being used to print some pages of the book or the like on one side of a sheet of paper and with the other plate of the pair being used to print a like number of other pages on the opposite side of the paper, with the printed paper later being folded into a signature and cut to separate its pages from one another. In this case, it is necessary that the various pages printed on both sides of the paper be properly registered and arranged relative to one another so that after the printed sheet of paper is folded and cut, the pages will appear in proper sequence, will read properly from top to bottom and will have the printed images properly located relative to the edges of the pages. It is, therefore, desirable that a way also be provided for quickly and inexpensively checking the image data to determine whether it satisfactorily fulfills these requirements of two-sided printing before using the data to expose sheets of printing plate media.

For color printing using process color techniques, it is necessary to provide three or four (or perhaps more) printing plates for each printed side of a printed sheet with each one of the plates being used with a respective one of the process colors, and different image data is used for the exposure of the photosensitive sheet used for making each of the plates. For an acceptable final color print, it is necessary that the images carried by the three or four process color plates be precisely registered with one another, and it is again desirable that some efficient procedure be made available to check on the accuracy of such registration before using the image data to expose the photosensitive printing plate media.

The general object of this invention is, therefore, to provide a proofing apparatus, and a related configuration of paper for use with such apparatus, for quickly, inexpensively and reliably checking the acceptability of image data to be used for subsequently driving a photoplotter in the exposure of photosensitive sheets of printing plate media.

A more specific object of the invention is to provide an apparatus and paper configuration of the above-mentioned kind wherein for proofing purposes the apparatus produces a proof print very closely resembling the print to be made by a printing press using a printing plate, or a set of process color printing plates, made from the same image data, so that errors in the image data can be found by visually inspecting the proof print.

A further object of the invention is to provide a proofing apparatus and related paper configuration which can be used for proofing either black and white or colored images.

A still further object of the invention is to provide a proofing apparatus and related paper configuration of the aforementioned character which may be used with image data for two matched printing plates, or two matched sets of process color plates, for printing on the two faces of a sheet, with the proofing apparatus printing the image of one plate or sets of plates on one face of a proof sheet and the image of the other plate or sets of plates on the other face of the proof sheet to produce a two-sided proof print permitting visual checking of page imposition, page registration and other factors involved in forming a signature from the printed sheet.

Other objects and advantages of the invention will be apparent from the following detailed description of a preferred embodiment of the invention and from the appended claims and drawings.

SUMMARY OF THE INVENTION

The invention resides in a sheet working apparatus with a friction mechanism for advancing sheets past a work station, and having a mechanism cooperating with relatedly configured sheets to assure consistently uniform and accurate introduction of the sheets to the friction advance mechanism.

In an exemplary application, the invention resides more specifically in an apparatus, and a related proof sheet, for printing onto one or both faces of the proof sheet, for visual inspection purposes, an image or images defined by image data intended for use in driving a photoplotter for exposing printing plate media, and in features of both the apparatus and proof sheet causing the image or images printed onto the proof sheet to be very accurately and reliably positioned on the proof sheet to allow definitive assessment of the correctness of image location defining instructions in the image data.

The invention more particularly resides in the apparatus being a raster printing ink jet printer, preferably a color ink jet printer, with the printer including a friction paper feed mechanism and a loading mechanism in advance of the feed mechanism which loading mechanism assures precise positioning of the proof sheet as it is fed into and through the paper feed mechanism and past the printing station.

The invention also resides in the printer having a print head movable along the printing station, which extends transversely of the path movement of the proof sheet through the printer, the print head carrying a photosensor which sensor, as the print head is moved along the printing station is operable to detect the position of one or both of the side edges of the proof sheet, and the printer including a control mechanism which is operable to reference the position of the printed graphic laterally of the sheet to the position of one of the side edges of the sheet as detected by the photosensor.

The invention still further resides in the proof sheet having an index opening formed in its leading portion, the index opening having an index edge extending perpendicularly to the side edges of the sheet, the control mechanism of the printer being operable before the index hole arrives at the printing station to align the photosensor with the path of the index hole and to then advance the sheet a sufficient amount to move the index hole past the photosensor for detection of the position of the index edge by the photosensor, and the control mechanism being further operable to reference the position of the printed graphic longitudinally of the sheet to the index edge.

The invention further resides in the arrangement of the index hole and the operation of the control mechanism being such, that in the case of printing two images respectively on the two faces of the proof sheet the same lateral edge of the sheet is referenced for positioning each of the two images laterally of the sheet and the same one index edge of the index hole is referenced in positioning each of the two images longitudinally of the sheet, so that the finished sheet printed on both faces can be used reliably to check the registration and imposition relationships of the two printed images.

The invention also resides in features of the printing apparatus by itself and in features of the proof sheet by itself.

The invention also resides in other details of the printing apparatus and proof sheet as defined by the claims and as described and illustrated in the accompanying description and drawings.

BRIEF DESCRIPTION OF THE DRAWINGS

In the drawings which illustrate a preferred embodiment of the invention.

DETAILED DESCRIPTION OF THE PREFERRED EMBODIMENT

Figure 1:
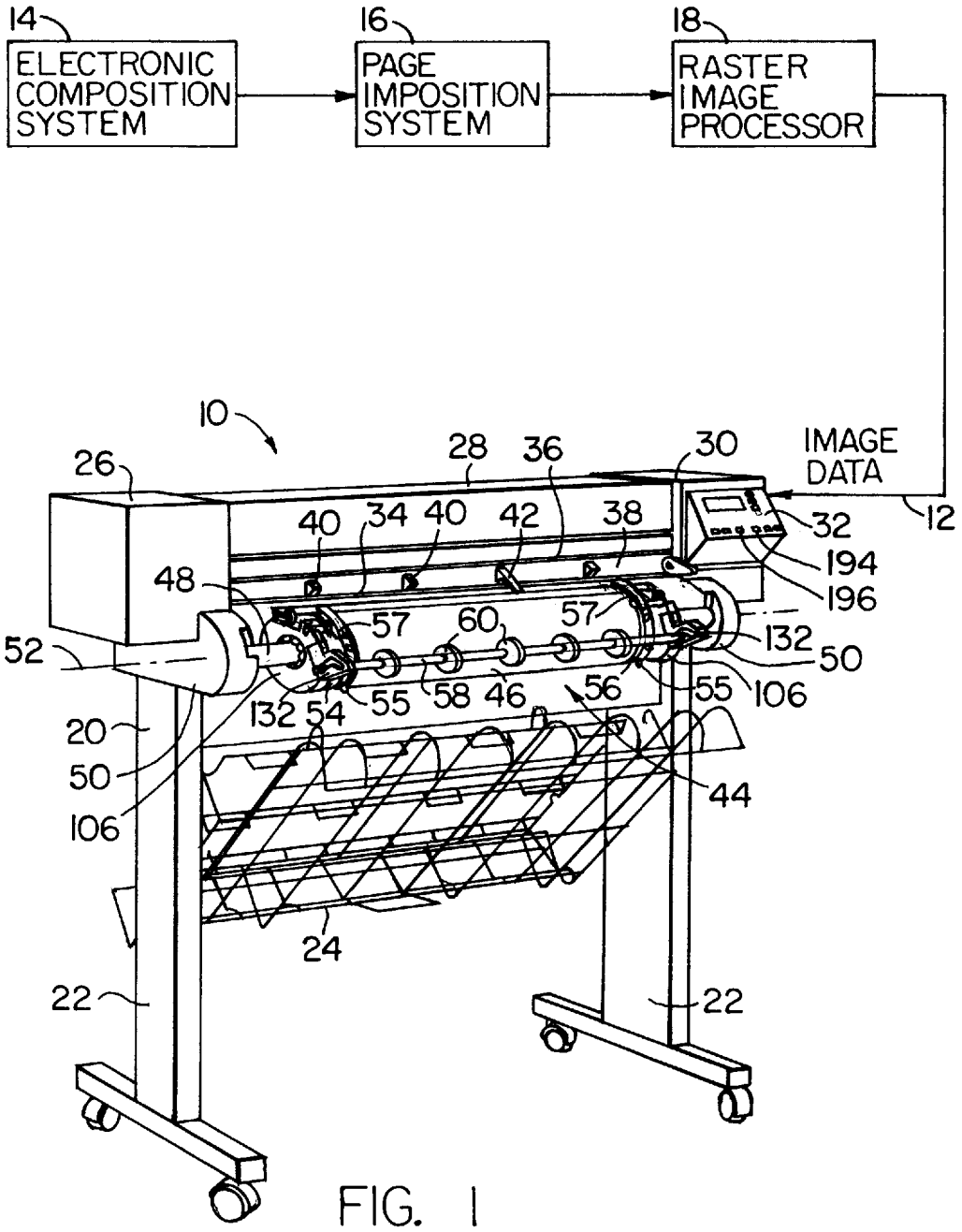
FIG. 1 is a perspective view of a printing apparatus embodying the invention.

Referring first to FIG. 1, an apparatus according to the invention is there shown and comprises a raster printer, indicated generally at 10 for printing onto a proof sheet, or other receiving sheet, graphic images corresponding to image data supplied from an external source to the printer, with such data in the illustrated case being shown to be supplied through the data input line 12. The image data may be provided in a wide number of ways, and in the illustrated case is taken to originate from an electronic composition system 14 working in cooperation with a page imposition system 16 and a raster image processor 18. The electronic composition system 14 may be of any well known type wherein, for example, portions of the graphic information making up a page are supplied by various different types of input providing digitized text and digitized artwork, the portions of the graphic material are laid out or assembled with one another to make up a page using an interactive visual display terminal, and the data representing each laid out page is output as a block of page data supplied to the page imposition system 16. The page imposition system then operates to arrange the blocks of page data into an arrangement to be used in exposing a sheet of printing plate media. The data issuing from the page imposition system is, therefore, a series of blocks of printing plate data each of which blocks of printing plate data represents the total image to be exposed on a single sheet of printing plate media. Each block of printing plate data is then transformed by the raster image processor 18 into blocks of image data with each block of image data representing the image to be exposed on a sheet of printing plate media with that data being in such format as to be usable by a raster scanning photoplotter and by a raster printing printer such as the printer 10.

The printer 10 is one having a friction sheet advance mechanism for feeding sheets of print receiving material through the printer. As used herein, the term friction sheet advance mechanism refers to one which does not use sprocket holes in the receiving sheets and cooperating sprocket pins in the printer for positively feeding the receiving sheets through the printer, but instead is one wherein each sheet of receiving material is fed through the printer by means of one or more feed rolls or wheels or belts which frictionally engage the receiving sheet to apply advancing forces to it with such rolls, wheels or belts possibly being knurled or otherwise roughened to enhance the frictional engagement between those elements and the receiving sheet. The printer 10 is preferably an ink jet printer and is also preferably a color ink jet printer permitting its use to print proof sheets in color when the image to be proofed is a colored one.

Various different commercially available raster printers with friction sheet advance mechanisms may be used to provide basic portions of the printer 10 with such commercially available printer being modified as needed to convert it into one, such as the printer 10, embodying the invention; and in the illustrated case, the printer is one made by the Hewlett Packard Company and identified as model number 750C and suitably modified.

The printer 10 has a frame 20 including two legs 22, a wire rack 24 held between the legs 22 for receiving and holding sheets as they are fed into and out of the printer and an upper enclosure 26. The enclosure 26 has a pivotally openable cover 28 covering the major portion of the sheet advance mechanism and printing mechanism, and at the right end of the enclosure 26, as seen in FIG. 1, is a control mechanism 30, having a control panel 32, which controls the operation of the sheet advance mechanism, the print head and other components of the printer.

The enclosure 26 has a horizontally extending input mouth 34 through which a receiving sheet may be introduced to the sheet advance mechanism, and a horizontally extending output slot 36 through which a receiving sheet leaves the printer after having been moved past the printing station by the advance mechanism. Between the input mouth 34 and the output slot 36 is a vertical outwardly facing wall 38 having a plurality of V-shaped protrusions 40 extending outwardly therefrom with each protrusion having a first surface 204 extending generally outwardly and downwardly from the output slot 36 and a second surface 206 (see FIG. 9) extending generally upwardly and outwardly from the input mouth 34, which two surfaces intersect to define the outward limit of the protrusion. As explained in more detail hereinafter in connection with FIG. 9, at least one of these protrusions is provided with a guide 42 extending generally outwardly from the protrusion to aid in preventing the portion of a receiving sheet which issues from the output slot from curling back into the input mouth and to also aid in keeping such issuing portion from taking on a cupped shape.

In accordance with the invention, the printer 10 in addition to the features described above, includes a sheet loading mechanism indicated generally at 44 for use in introducing a sheet of receiving material through the mouth 34 and to the sheet advance mechanism, with the loading mechanism 44 assuring that the sheet is fed accurately into the sheet advance mechanism so as to feed in a straight line through the printer without skewing or otherwise shifting laterally. As seen in FIG. 1 and as described in more detail hereinafter, the loading mechanism 44 includes an input guide roll 46 on a shaft 48 rotatably held by two forwardly projecting arms 50 of the frame 20 so that the shaft and guide roll are freely rotatable about a guide roll axis 52 extending parallel to the input mouth 34 and output slot 36. The guide roll has opposite end portions 54 and 56, each provided with a set of sprocket pins, and associated with each set of sprocket pins is a bail 57 for holding a receiving sheet with sprocket holes onto the sprocket pins. A biasing roll 58 is located on the opposite side of the guide roll from the input mouth 34 and carries a number of wheels 60, preferably made of rubber or other resilient material, which during the feeding of a receiving sheet into the printer engage the sheet to hold it onto the guide roll and also exert a force on the guide roll tending to resist rotation of the guide roll in the direction corresponding to movement of the receiving sheet into the input mouth thereby tensioning the portion of the receiving sheet extending between the biasing roll 58 and the sheet advance mechanism.

Figure 3:
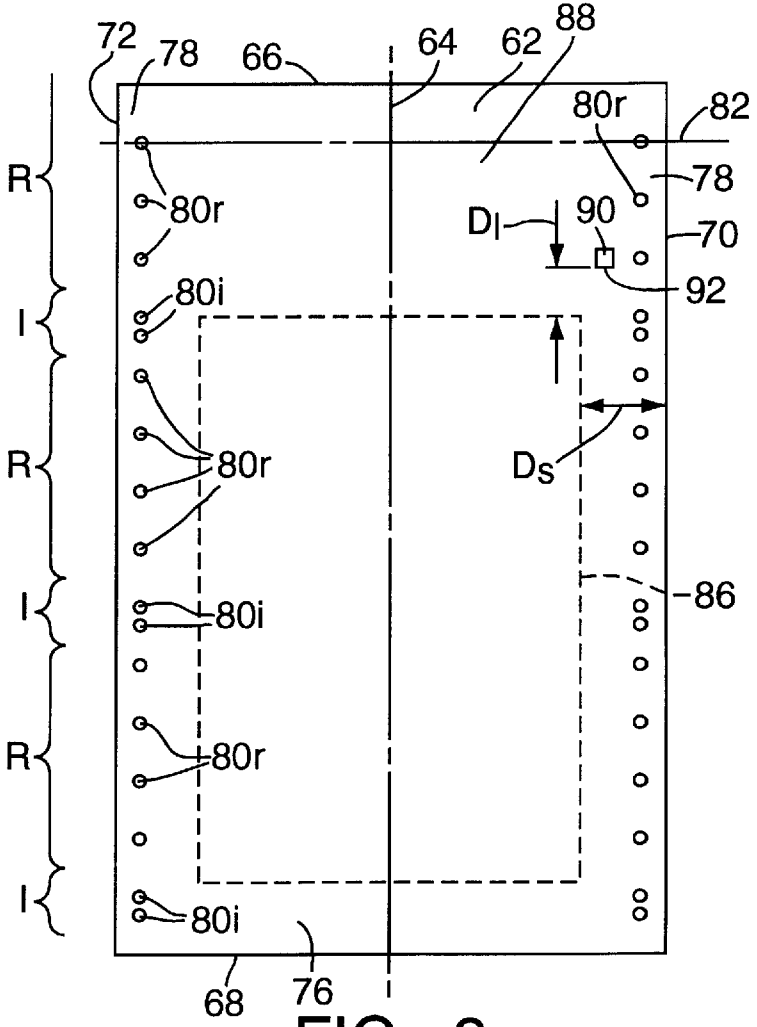
FIG. 3 is a view similar to FIG. 2 but showing the opposite face of the proof sheet.
Figure 2:
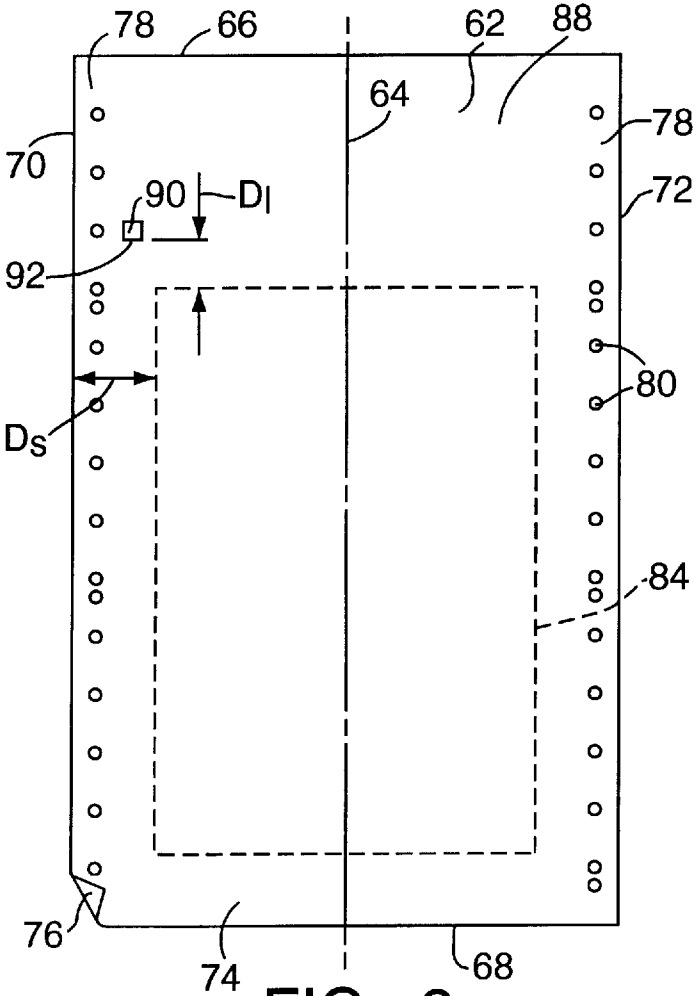
FIG. 2 is a plan view showing one face of a proof sheet embodying the invention.

Turning now to FIGS. 2 and 3, these figures show respectively both faces of a sheet of receiving material, referred to herein as a proof sheet 62 for use in conjunction with the printer 10 for proofing purposes. The sheet 62 has a longitudinal axis 64 and is of rectangular shape with a leading end edge 66, a trailing end edge 68 and two side edges 70 and 72, the sheet therefore having a first face 74 and a second face 76. FIG. 2 shows primarily the first face 74 and FIG. 3 the second face 76, the sheet in FIG. 3 being rotated 180° about the longitudinal axis 64 from the sheet as seen in FIG. 2. The sheet has two lateral marginal portions 78 each extending along and adjacent to a respective one of the side edges 70 and 72 and each marginal portion contains a row of sprocket holes 80 spaced from one another along the length of the sheet for cooperation with the sprocket pins of the guide roll 46.

Preferably, the sprocket holes 80 of the sheet 62 are arranged in accordance with a scheme, such as shown by U.S. Pat. No. 4,834,276 and 4,867,363, which inhibits misleading of the sheet onto the guide roll sprocket pins in a skewed condition, the scheme being such that the sprocket holes 80 are arranged and/or configured so that some of the holes are readily distinguishable by an operator from other of the holes and serve as indicator holes to be placed on corresponding indicator pins of the guide roll. Various different hole schemes may be employed, and in the illustrated case, as shown in FIG. 3, the sprocket holes in each lateral marginal portion 78 are arranged into groups R each containing four regularly spaced regular sprocket holes $\mathbf{80}_r$ and which groups R are separated from one another by indicator zones I each containing two indicator sprocket holes $\mathbf{80}_i$ with the indicator holes $\mathbf{80}_i$ of the indicator zones being so spaced relative to one another and to the adjacent regular sprocket holes $\mathbf{80}_r$ as to cause an interruption in the regular spacing of the sprocket holes readily discernible to an operator. The arrangement of the sprocket holes is the same in each of the lateral marginal portions 78 of the sheet and each hole in one marginal portion 78 has a corresponding hole in the other lateral portion with both of said corresponding holes being located on a line, such as the line 82 of FIG. 3, extending perpendicularly to the side edges 70 and 72.

In FIG. 2 the broken line box 84 indicates the area of the first face 74 of the sheet onto which a graphic is to be printed by the printer 10, and in FIG. 3 the broken line box 86 represents the area of the second face 76 onto which a graphic is to be printed by the printer 10. A leading portion 88 of the sheet is located between the leading edge 66 and the print areas 84 and 86, and in this leading portion is an index opening 90 having a straight index edge 92 extending perpendicularly to the side edges 70 and 72. As explained in more detail hereinafter, as the proof sheet 62 is initially introduced into the printer 10 a photosensor detects the position of the side edge 70 and uses such detected position of the edge 70 as a reference for use by the control mechanism in positioning the print areas 84 and 86 laterally of the proof sheet as indicated by the dimension $D_s$ in FIGS. 2 and 3. Also, during the introduction of the sheet into the printer, the photosensor detects the index edge 92 of the index opening 90 and the control mechanism 30 of the printer uses that detected position of the index edge 92 as a reference for positioning the print areas 84 and 86 longitudinally of the sheet 62 as indicated by the dimension $D_1$ of FIGS. 2 and 3. Therefore, both of the print areas 84 and 86 on the two faces 74 and 76 of the sheet are referenced laterally to the same side edge 70 and longitudinally to the same index edge 92 to reduce or eliminate registration errors between said two print areas.

Figure 4:
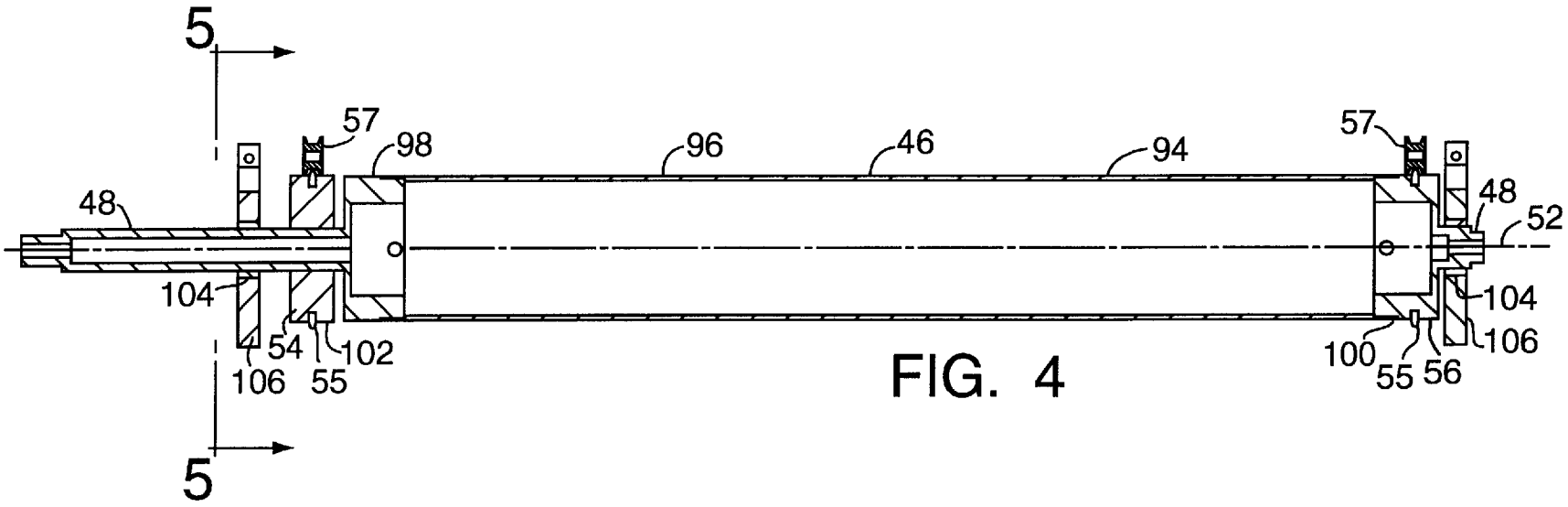
FIG. 4 is a vertical sectional view taken through the guide roll of the apparatus of FIG. 1.

The guide roll 46, as shown in FIG. 4, is made up of a main body 94 including a sheet metal cylinder 96 connected at its left-hand end to an end cap 98 and at its right-hand end to an end cap 100, the end cap 98 having fixed to it a left-hand portion of the shaft 48 and the end cap 100 having fixed to it a right-hand portion of the shaft 48 which shaft portions are respectively rotatably received and held in receiving slots of the frame arms 50 as shown in FIG. 1. The guide roll also includes a cylindrical end piece 102 received on the left portion of the shaft 48 adjacent the end cap 98. Together, the right end cap 100 and the left end piece 102 define the two end portions of the guide roll which respectively carry the two sets of sprocket pins 55 of the guide roll. As shown in more detail hereinafter in connection with FIGS. 7 and 8, the end piece 102 is adjustable on the left portion of the shaft 48 both linearly along the length of the guide roll axis 52 and angularly about that axis to change the spacing between the two sets of sprocket pins to accommodate changes in the spacing between the two rows of sprocket holes in the proof sheet 62 and to bring the two sets of sprocket pins into such angular relationship to one another as to feed the proof sheet into the printer along a desired straight line to cause the image printed on the sheet to be accurately located.

Figure 5:
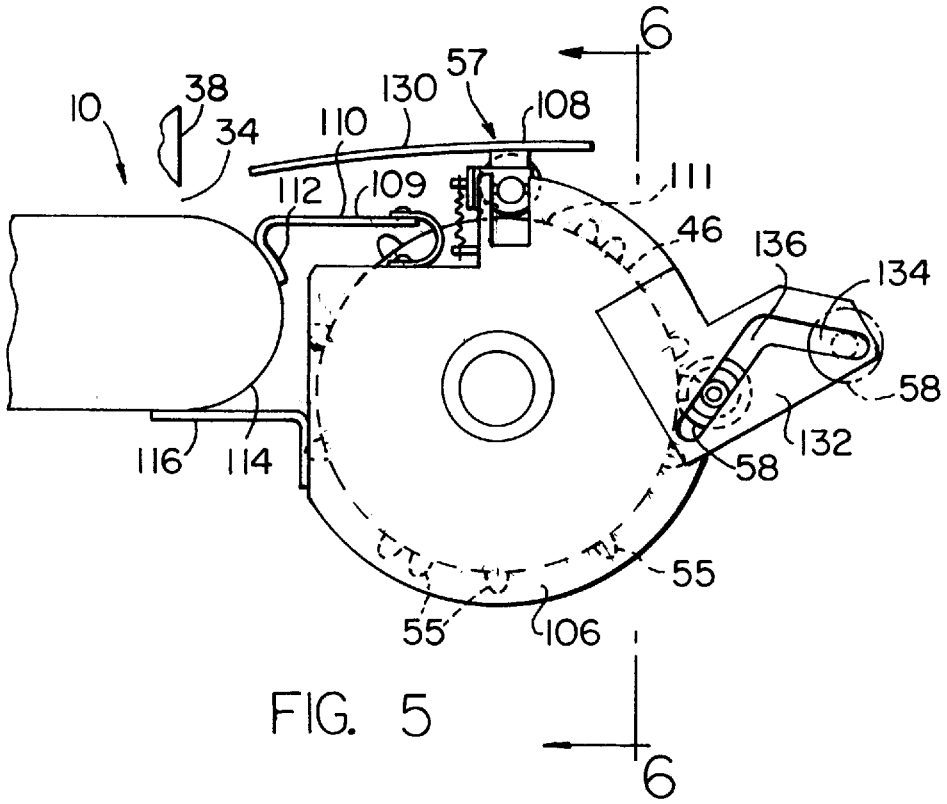
FIG. 5 is a vertical sectional view taken on the line 5—5 of FIG. 4.

Rotatably supported, as by bearings 104, on the shaft 48 are two auxiliary support members 106. As shown in FIG. 5, which illustrates the left auxiliary support member 106 of FIG. 4, each auxiliary member 106 serves to support a bail 108 associated with the adjacent set of sprocket pins 55 and one end of a support plate 110. As noted in FIG. 5, the guide roll 46 is located in advance of the printer input mouth 34 and the support plate 110 serves to close the gap between the guide roll and the input mouth to provide a horizontal support surface 109 for vertically supporting the proof sheet as it passes from the guide roll to the input mouth. The support plate 110 also aids in disengaging the proof sheet from the sprocket pins 55 of the guide roll. The uppermost part 111 of the outer surface of the guide roll cylinder 96 is located at the level of the advance mechanism input mouth 34. The edge of the support plate 110 adjacent the guide roll is positioned close to said uppermost part 111 of the guide roll surface, and the edge of the support plate 110 adjacent the printer 10 is turned down as shown at 112 to engage a rounded front nose 114 of the printer and a bracket 116 carried by the auxiliary member 106 also engages the rounded nose 114 as shown in FIG. 5 to prevent rotation of the auxiliary member about the shaft 48.

Figure 6:
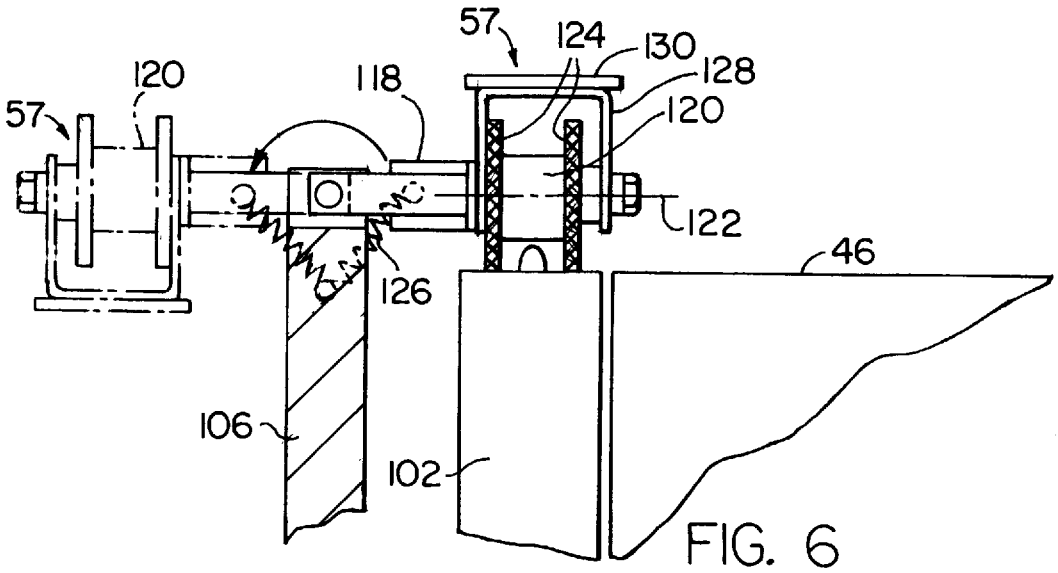
FIG. 6 is a fragmentary view taken on the line 6—6 of FIG. 5 and showing the construction of one of the bails of the apparatus of FIG. 1.

Each bail, as shown in FIG. 6, is made up of a bail body 118 pivotally supported by the associated auxiliary member 106 for movement between a closed position as shown by the full lines of FIG. 6 and an open position shown by the broken lines of FIG. 6. The body 118 carries a hold down wheel 120 for rotation about an axis 122 which extends parallel to the guide roll axis 52 when the bail is in its closed position, the wheel 120 having two spaced tires 124 which straddle the pins of the associated set of sprocket pins to hold the sheet received on those pins against the guide roll. A tension spring 126 working between the auxiliary member 106 and the bail body 118 resiliently holds the bail in both its open and closed positions. A U-shaped member 128 fixed to the bail body carries a flexible guide strip 130, preferably made of a plastic material, which extends forwardly from the bail, as shown in FIG. 5, to aid in guiding the proof sheet issuing from the output slot 36 over the hold down wheel to prevent it from going under the hold down wheel 120.

As shown in FIGS. 1 and 2, the auxiliary members also serve to support members 132 for supporting the biasing roll 58. Each member 132 is fixed to a respective one of the auxiliary members 106 and contains a slot having an upper portion 134 and a lower portion 136. Each of the end portions of the biasing roll 58 is received in the slot of a respective one of the members 132. As can be seen in FIG. 5, the slot portions 134 and 136 are so arranged that when the biasing bar is moved to the upper portions 134 of the slots, the bar will be held by its own weight in spaced relationship to the guide roll 46, thereby forming a gap between the guide roll and the biasing roll through which the proof sheet may be moved in loading the proof sheet onto the guide roll. After the proof sheet is loaded onto the guide roll, the biasing bar is moved by the operator to the lower portions 136 of the slots and, as will be evident from FIG. 5, in this position, the shape and arrangement of the lower portions 136 of the slots are such that the biasing roll by its own weight will be biased downwardly and toward engagement with the guide roll 46, thereby holding the proof sheet to the guide roll and also exerting a force on the guide roll tending to resist rotation of the guide roll about its axis 52 in the direction corresponding to movement of the proof sheet into the printer and thereby, after the proof sheet has been grasped by the sheet advance mechanism of the printer, tensioning the portion of the proof sheet which extends between the guide roll and the sheet advance mechanism of the printer.

Figure 7:
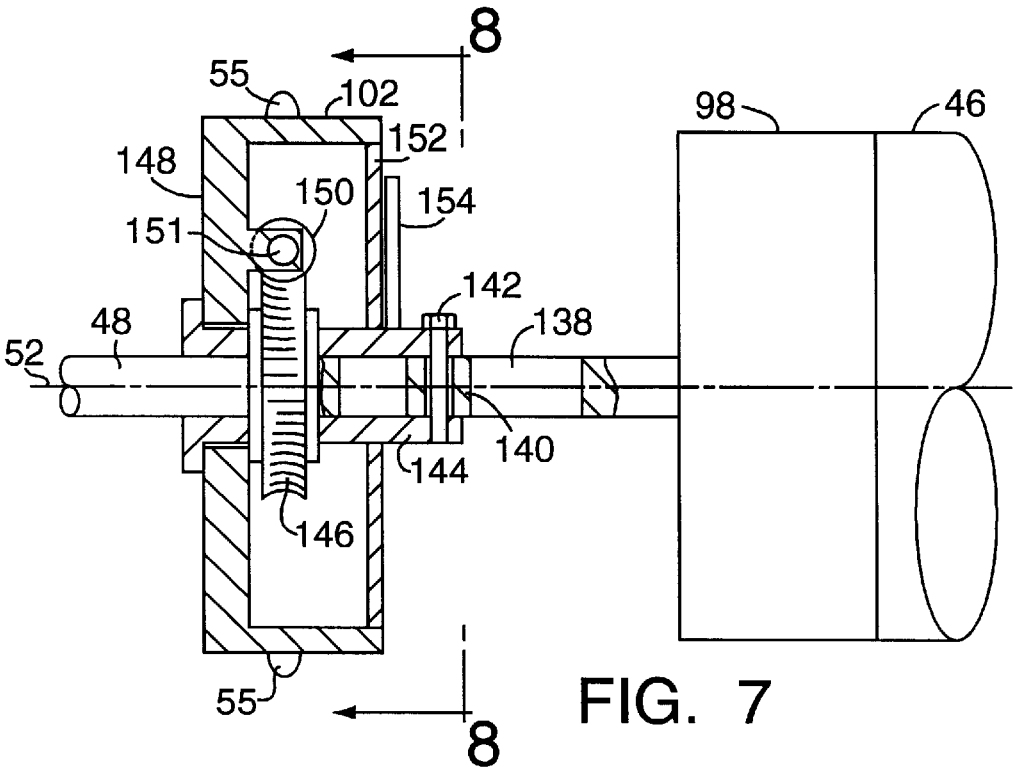
FIG. 7 is a fragmentary view partially in elevation and partially in vertical section showing the sprocket pin adjustment mechanism of the guide roll.
Figure 8:
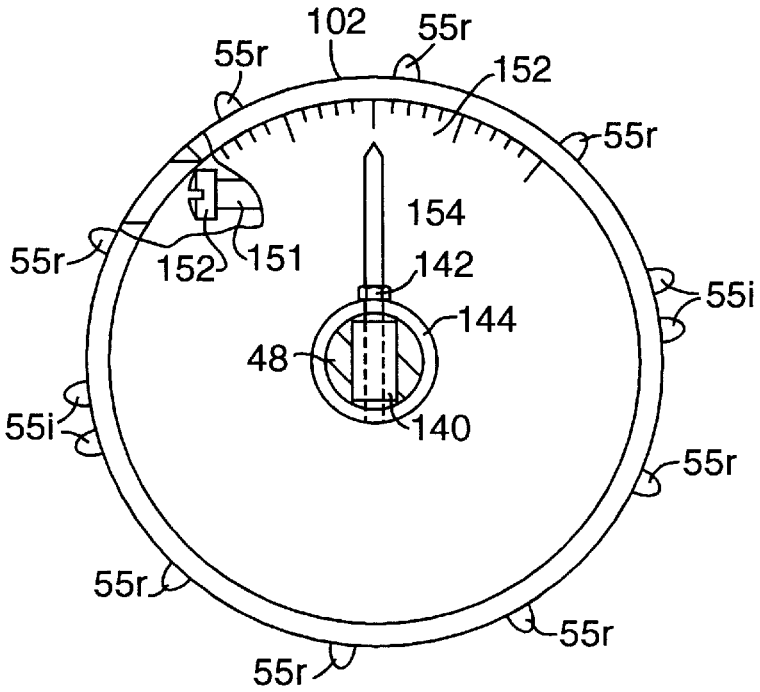
FIG. 8 is a vertical sectional view taken on the line 8—8 of FIG. 7.

As already mentioned in connection with FIG. 4, the end portion 102 of the guide roll 46 is adjustable both linearly and angularly relative to the remainder of the guide roll to permit adjustment of the spacing and angular alignment between the two sets of sprocket pins 55 of the guide roll. This adjustment may be accomplished in a wide number of ways without departing from the invention but, as shown in FIG. 7, in one form of adjustment mechanism the left portion of the shaft 48 contains a slot 138 receiving a slider 140 constrained by the slot to sliding movement along the guide roll axis 52. Fixed to the slide, as by a screw 142, is a bushing 144 received on the shaft 48 and slidable therealong with the slider 140. Centered on and fixed on the bushing 144 is a worm gear 146. The end piece 102 is in the form of a cup shaped member with an end wall 148 rotatably supported on the bushing 144 for rotation relative to the bushing about the guide roll axis 52 and restrained against movement relative to the bushing 144 along the axis 52, with the end piece 102 also including a cylindrical outer flange 102 carrying the associated sprocket pins 55. The end wall 148 of the end piece 102 rotatably supports a worm 150 meshing with the worm gear 146 and which worm, as shown in FIG. 8, is fixed to a shaft 151 having a head 152 accessible through a hole in the cylindrical flange 102 for rotation by a screwdriver or similar tool. Thereby, by rotation of the worm 150 in one direction or the other about its axis, the end piece 102 can be rotated in one direction or the other about the guide roll axis 52 relative to the shaft 48 to change the angular relationship between the sprocket pins 55 carried by it and the sprocket pins 55 carried by the right-hand end portion of the guide roll 46. To aid in this adjustment, the end piece 102 preferably at its right-hand end has fixed to it a graduated indicator plate 152 cooperating with a pointer 154 fixed to the bushing 144 to indicate the angular position of the end piece 102. The bushing 144 may also be slid along the length of the shaft 48 to change the spacing between the two sets of sprocket pins, and such sliding adjustment may be performed manually by the operator when loading a proof sheet onto the guide roll.

From FIG. 8 it will also be noted that the sprocket pins 55 are arranged on the end piece 102 in an arrangement complementary to that of the arrangement of the sprocket holes 80 in each lateral marginal portion of the proof sheet 62. That is, the sprocket pins $55_i$, on the piece 102 include two groups of four regularly spaced pins 55 which two groups are spaced from one another by two indicator pins $55_i$, $55_i$; and the sprocket pins 55 on the right-hand end portion of the guide roll, as seen in FIG. 1, are arranged in a pattern identical to that of the pins 55 on the end piece 102 as shown in FIG. 8. In loading a proof sheet onto the guide roll 46, the guide roll is first moved by hand, if necessary, to bring a set of indicator pins $55_i$; to approximately the uppermost portion of the guide roll path and then the two indicator sprocket pin holes $80_i$ closest to the leading edge 66 of the proof sheet are placed onto the corresponding ones of the indicator pins $55_i$; of the guide roll. In connection with this, it should further be noted that the indicator holes $80_i$ of the proof sheet 62 which are located closest to the leading edge 66 are preferably so spaced from the leading edge 66 that when they are placed onto upwardly positioned indicator pins $55_i$ of the guide rolls, the portion of the proof sheet 62 extending from the guide roll toward the input mouth of the printer will be of approximately the length required to position the leading edge 66 very close to or slightly into the input mouth 34.

Figure 9:
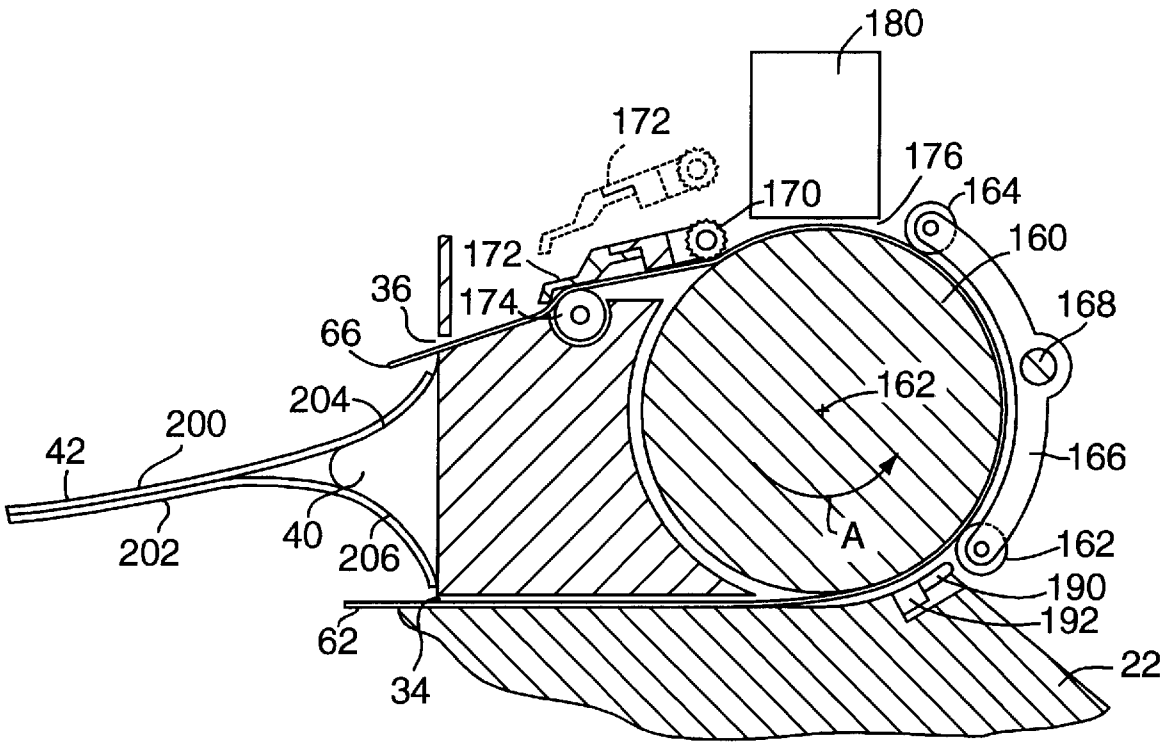
FIG. 9 is a vertical sectional view showing the sheet advance mechanism of the FIG. 1 apparatus.
Figure 10:
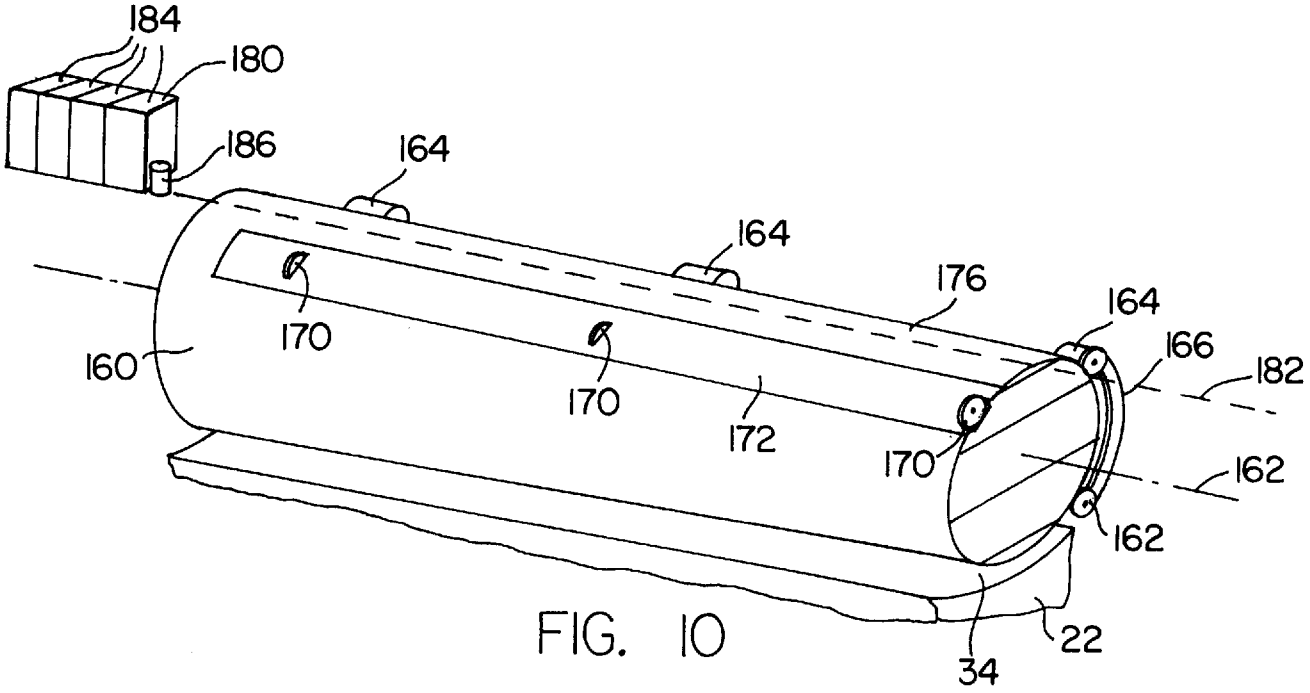
FIG. 10 is a schematic perspective fragmentary view showing the sheet advance mechanism and printing mechanism of the apparatus of FIG. 1.

FIGS. 9 and 10 show the sheet advance mechanism of the printer 10. Referring to these figures, the sheet advance mechanism comprises a feed roll 160 supported for rotation about a feed roll axis 162 relative to the frame 22 of the printer. The input mouth 34 as shown in these figures is shaped so as to guide a proof sheet 62 to the feed roll 160 as the leading edge 66 is pushed into the mouth 34. The sheet 62 is held to the feed roll 160 by a set of first counter rollers 162 and a set of second counter rollers 164. The rollers 162 and 164 are spaced along the length of the feed roll 160 and are carried by spaced brackets 166 each of which brackets 166 rotatably carries one roller 162 and one roller 164, and the brackets 166 are carried by a common support rod 168 which is carried by the frame 22 and spring loaded relative to the frame so that it, the brackets 166 and the rollers 162 and 164 are biased toward engagement with the feed roll 160 and with the proof sheet passing around the feed roller.

The proof sheet 62 is also held to the feed roll by a set of star wheels 170 aligned with the counter rollers 164 and carried by a guide strip 172 extending along the length of the feed roller. During the initial loading of the proof sheet 62 into the sheet advance mechanism, the guide strip 172 is first moved to the raised position shown by the broken lines in FIG. 9 and is then moved to the lowered position shown by the full lines after the leading edge 66 of the sheet has moved past the guide strip 172. Ahead of the star wheels 170 in the direction of movement of the proof sheet 62 through the sheet advance mechanism, are a set of tensioning rolls 174 which are aligned with the star wheels 170 and which are driven so as to have tangential speeds slightly greater than the tangential speed of the feed roll 160 so that the portion of the proof sheet passing from the feed roll 160 to the tensioning rolls 174 is tensioned by the tensioning rolls 174 to aid in holding the proof sheet to the feed roll in the printing zone 176, which printing zone is located between the counter rolls 164 and the star wheels 170 and extends along the length of the feed roll.

For printing onto the proof sheet 62, the printer has a print head 180 movable by suitable drive means controlled by the control mechanism 30 along a print head axis 182 extending along the printing station 176 parallel to the feed roll axis 162. As mentioned, the printer 10 is preferably one for printing colored graphic images and, therefore, the print head 180, in the illustrated case, is one having four separate ink jet cartridges 184 for printing respectively with the three process colors cyan, magenta and yellow and the color black. Additionally, the print head 80 carries a photosensor 86 capable of detecting edges on the proof sheet 62 when positioned on the feed roll 160. The photosensor may be of various different types but preferably is one which has a light emitter for directing a beam of light onto a sensing area, and a light detector for detecting light reflected from the sensing area, with the sensing area being so arranged as to move over the upper surface of the proof sheet received on the feed roll when the print head is moved along the print head axis 82. To maximize the sensitivity of the photosensor 86, the surface of the feed roll 160 is preferably of a black or other dark color so as to have a light reflectivity greatly different from the light reflectivity of the proof sheet 62.

As to the operation of the sheet advance mechanism and of the print head 180, as previously mentioned, a proof sheet 62 to be printed upon by the printer 10 is first mounted onto the guide roll 46 with its leading indicator sprocket holes $80_i$ put onto upwardly directed indicator sprocket pins $55_i$ of the guide roll, the biasing roll 56 is moved to the lower portions of its supporting slots so as to hold the proof sheet to the guide roll, and the two bails are moved to their closed positions to further hold the proof sheet onto the guide roll and into secure relationship with sprocket pins.

At this point, the leading edge 66 of the proof sheet is already located very close to or slightly in the input mouth 34. The guide roll is then moved by hand to-push the leading edge 66 of the proof sheet further into the input mouth 34 until the leading edge 66 comes into engagement with the first set of counter rolls 162. Immediately before coming into engagement with the counter rollers 162, the leading edge 66 engages the actuating reed 190 of a reed switch 192, and in response to this actuation the control mechanism 30 causes the feed roll 160 to be rotated counter clockwise, as seen in FIG. 9 and shown by the arrow (A), by an increment sufficient to move the leading edge 66 about one inch beyond the counter rolls 162 and to then stop. In response to the actuation of the switch 192 the control mechanism 30 also causes the star wheel carrying guide strip 162 to be raised to its raised position.

The operator then operates a selector on the control panel 32 of the control mechanism to indicate to the control mechanism which face of the proof sheet is intended to be printed upon. For this purpose, the face 74 shown in FIG. 2 may be referred to as "side A" and the face 76 shown in FIG. 3 may be referred to as "side B". The selector may take various different forms but preferably comprises two buttons or touch pads 194 and 196 on the control panel 32, the touch pad 194 being pushed to indicate "side A" and the touch pad 196 being pushed to indicate "side B". The control mechanism then again causes the feed roll to be driven by an increment, and this time it is driven a sufficient amount to bring the leading edge of the proof sheet slightly past the guide strip 172 carrying the star wheels 170, and then the rotation of the feed roll is stopped and the guide strip 172 moved to its lowered position as shown by the full lines of FIG. 9.

The control mechanism then causes the print head 180 to be moved along the print head axis 182 along the entire length of the printing station 176 so that the photosensor 186 will detect both side edges 70 and 72 of the proof sheet 62. Because of the prior pushing of either the touch pad 194 or the touch pad 196, the control mechanism 30 knows which of the two detected edges is the edge 70 to be used for reference purposes and will use the detected position of that edge 70 as a reference for determining the lateral position of the related print area 84 or 86 on the proof sheet.

At this time, the index hole 90 is still positioned behind the path followed by the sensing area of the photosensor 186 as the print head moves along the print head axis 182. The control mechanism 30 then next operates to cause the print head 180 to be so positioned that the sensing area of the photosensor 186 will be located in line with the path followed by the index hole 90 as it moves through the printing station. Depending upon which face 74 or 76 of the control of the proof sheet is intended to be printed upon, the index hole will be located either near the left-hand end or near the right-hand end of the feed roll, and the control mechanism 30 operates in response to the previous pushing of the side selecting touch pad 194 or touch pad 196 to position the print head at the proper position suiting the selected face.

After this positioning of the print head, the control mechanism again operates to move the feed roll incrementally with the amount of movement being sufficient to move the index hole past the sensing area of the photosensor 86, and then the feed roll stops. During this movement, the photosensor detects the position of the index edge 92 relative to the feed roll and the control mechanism 30 later uses this detected position as a reference for positioning the related print area 84 or 86 longitudinally of the proof sheet. If no index hole is detected by the photosensor 186 during this movement of the proof sheet, the control mechanism 30 operates to prevent subsequent printing of a graphic onto the proof sheet. This feature prevents misprinting onto the control sheet as a result of the control sheet having been improperly loaded into the printer as, for example, by inserting the trailing edge 68 rather than the leading edge 66 into the printer or by feeding the leading edge of the proof sheet into the printer with the wrong face of the proof sheet facing upwardly.

After the detection of the index edge 92 by the photosensor and the movement of the feed roll having been stopped, the printer is ready for printing onto the proof sheet, and upon actuation of appropriate touch pads on the control panel, the printing of a graphic in accordance with the image data onto the proof sheet will then begin with the feed roll first being driven to move the proof sheet to a given longitudinal starting position referenced to the position of the index edge as detected by the photosensor and with the raster printing process then starting with the lateral position of the raster scan lines being referenced to the position of the side edge 90 as detected by the photosensor.

As the printing process progresses, the leading portion of the proof sheet issues from the output slot 36 and it is possible that the issuing portion may take on a curled shape causing the leading edge 62 to re-enter the input mouth 32, or the issuing portion may sometimes take on a cupped, upwardly convex, shape tending to lift the side edges of the sheet from the feed roll. As mentioned, to prevent these occurrences, at least one of the protuberances 40 is provided with an elongated outwardly extending guide 42 for guiding the issuing portion of the proof sheet away from the input mouth 34 and for providing vertical support inhibiting cupping of the sheet. As shown in FIG. 9 the guide 42 preferably consists of two thin flexible strips 200 and 202. The strip 200 has an inner portion attached to the upper surface 204 of the protrusion 40 and the strip 202 has an inner portion attached to the lower surface 206 of the protrusion 40. Both strips of 200 and 202 have outwardly extending portions engaging one another as shown in FIG. 9. Preferably, each strip 200 and 202 is made from a plastic material having a pressure sensitive layer of adhesive, which adhesive layer is used to attach the strip to the protrusion 40 and also serves to secure the two outwardly extending portions of the strips to one another.

Figure 11:
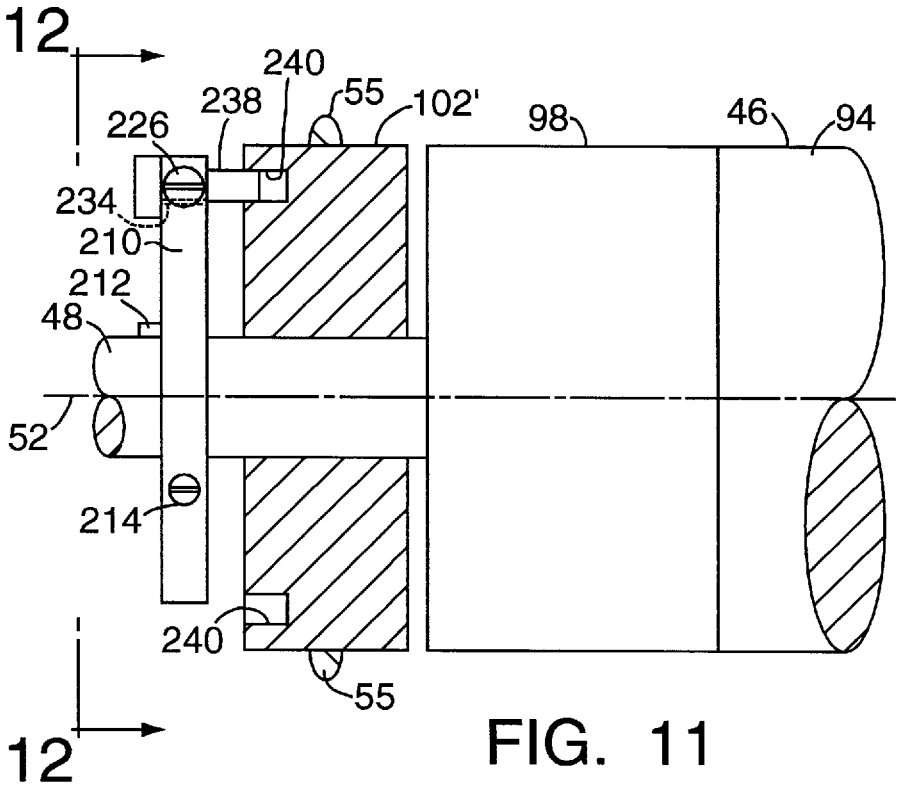
FIG. 11 is a view similar to FIG. 7 but showing an alternative form of sprocket pin adjustment mechanism of the guide roll.
Figure 12:
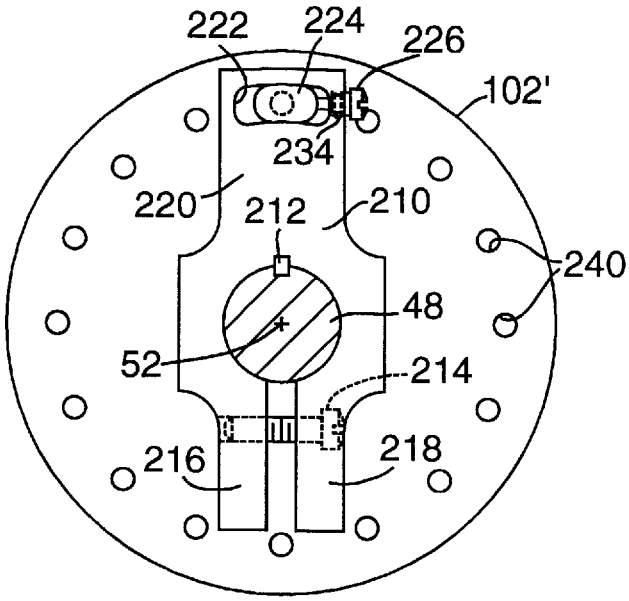
FIG. 12 is a vertical sectional view taken on the line 12—12 of FIG. 11.
Figure 13:
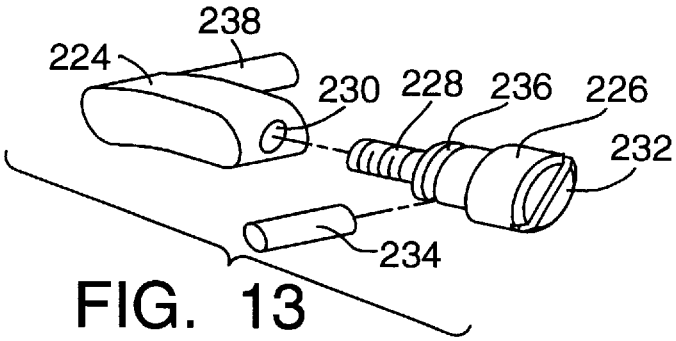
FIG. 13 is a perspective exploded view of the slide, adjustment screw and screw retaining pin forming part of the adjustment mechanism of FIGS. 11 and 12.

An alternative form of sprocket pin adjustment mechanism, which may be used in place of the mechanism shown in FIGS. 7 and 8, is shown in FIGS. 11 to 13. Referring to FIGS. 11 to 13, in the adjustment mechanism there shown, the left-hand end piece 102' of the guide roll 46 is loosely mounted on the shaft 48 of the guide roll so as to be angularly and linearly slidable relative to the shaft, and is positioned close to the left-hand end of the left-hand end cap 98 of the main body 94 of the guide roll, which end cap 98 limits movement of the end piece 102' to the right as seen in FIG. 11.

On the opposite side of the end piece 102' from the end cap 98 is a driver bracket 210 which is received on the shaft 48 and angularly fixed thereto by a key 212. The driver bracket 210 is clamped against linear movement relative to the shaft 48 by a screw 214 threadably received by one lower arm 216 of the bracket and loosely passing through an opposite arm 218 of the bracket. When the clamping screw 214 is loosened, the bracket 210 may be slid linearly relative to the shaft 48 and key 212.

An upper arm 220 of the bracket contains an arcuate slot 222 receiving a slide 224, with the slot 222 and the slide 224 being complementarily shaped so that the slide is restrained by the slot to movement relative to the bracket along an arcuate path centered on the axis 52 of the guide roll 46. The slide 224 is positioned in the slot 224 by an adjustment screw 226 having a threaded shank 228 threadably engaged with a threaded opening 230 in the slide and having a slotted head 232 which may be turned either by hand or by a screwdriver. The adjustment screw is held to the bracket 220 by a retaining pin 234 press fitted into the bracket 220 and in part received by a cooperating retaining groove 236 formed in the adjustment screw 226 as seen best in FIG. 13. As also seen in FIGS. 11 and 13, the slide 224 carries a dowel pin 238 slidably receivable in any one of a number of angularly spaced openings 240 formed in the left-hand end face of the end piece 102'.

Therefore, when the dowel pin is engaged with a particular one of the holes 240, as shown in FIG. 11, the dowel pin holds the end piece 102' against angular movement relative to the shaft 48, but the end piece 102' may nevertheless be shifted linearly relative to the shaft 48 to change the spacing between the two sets of sprocket pins. Further, the angular relationship between the two sets of sprocket pins may be varied by turning the adjustment screw 228 in one direction or the other, thereby moving the slide 224 in the slot 222 and causing the dowel pin 228 carried by the slide to correspondingly shift the end piece 102' angularly relative to the shaft 48. This adjustment effected by rotation of the adjustment screw 226 is a fine adjustment and has a range limited by the length of the slot 222. If a greater amount of angular adjustment is required, a coarser adjustment can be obtained by loosening the clamping screw 214, shifting the bracket 210 to the left as seen in FIG. 11 until the dowel pin 238 leaves its presently occupied hole 240, then rotating the end piece 102' to bring a new hole 240 into alignment with the dowel pin 238, shifting the bracket 210 to the right to bring the dowel pin 238 into engagement with the new hole 240, and then reclamping the bracket 210 to the shaft 48 by tightening of the clamping screw 214.

We claim:

1. The combination of an apparatus and a paper proof sheet for use in proofing image data to be used by a photoplotter in raster exposing a graphic image on a photosensitive surface of a sheet of printing plate media, wherein:

said apparatus comprises a raster printer for printing onto said proof sheet a proofing image using said image data so that said proofing image corresponds closely to the image to be exposed on a sheet of printing plate media by a photoplotter using said image data, said raster printer has a frame and a friction sheet advance mechanism for advancing said proof sheet through said printer along a given feed path, said friction sheet advance mechanism having an input mouth with a length dimension extending generally horizontally and perpendicularly to said feed path, an input guide roll is located in advance of said input mouth and mounted for free manual rotation independently of said advance mechanism and relative to said frame about a guide roll axis extending generally parallel to said length dimension of said input mouth, said guide roll having two opposite end portions spaced from one another along the length of said guide roll axis, each of said end portions of said guide roll carrying a set of sprocket pins arranged in circumferentially spaced relation to one another about the circumference of the associated end portion, said guide roll having an outer cylindrical surface extending substantially continuously between said two opposite end portions and said cylindrical surface having an uppermost part, and means providing a horizontal support surface between said uppermost part of said outer cylindrical surface of said guide roll and said input mouth to vertically support said proof sheet in the area between said guide roll and said input mouth, and said proof sheet of paper is of rectangular shape and has a longitudinal axis, said proof sheet having leading and trailing end edges extending transversely to said longitudinal axis and two spaced side edges extending parallel to said longitudinal axis, said proof sheet having two lateral marginal portions located respectively adjacent each of said two side edges of said sheet and a leading portion located adjacent said leading edge, and each of said lateral marginal portions of said proof sheet having a row of sprocket holes formed therein and spaced from one another longitudinally of said sheet so that in introducing said proofing sheet to said printer said leading portion of said sheet may first be placed onto said guide roll with the ones of said sprocket holes included in said leading portion being placed on sprocket pins of said two end portions of said guide roll and so that said guide roll may then be rotated manually to move said leading edge of said proof sheet into said mouth of said printer with said sprocket pins of said guide roll and said sprocket holes of said proofing sheet maintaining accurate positioning of said proof sheet relative to said friction sheet advance mechanism of said printer and with said horizontal support surface vertically supporting said proof sheet in the area between said guide roll and said input mouth.

2. The combination defined in claim 1, wherein said raster printer is an ink jet printer.

3. The combination defined in claim 2, wherein said ink jet printer is a process color ink jet printer.

4. The combination defined in claim 1, wherein said sheet advance mechanism includes a main feed roll supported for driven rotation relative to said frame about a feed roll axis generally parallel to said axis of said guide roll, said printer has a horizontally extending output slot spaced above said input mouth, and said feed path extends from said input mouth to partially around said feed roll to from said feed roll to said output slot with the portion of said feed path which passes around said feed roll passing through a printing station extending along the length of said feed roll, said printer includes a print head movable over said printing station along a print head axis parallel to said guide roll axis for raster printing onto said proof sheet, said printer includes a control mechanism for controlling the operation of said sheet advance mechanism and of said print head, said print head carries a photosensor including a light emitter for emitting light onto a sensing area fixed relative to said photosensor and a light detector for detecting light reflected from said sensing area, said sensing area being positioned so that said photosensor is capable of detecting edges on said proof sheet as relative motion occurs between said photosensor and said proof sheet, said control mechanism is operable during the loading of said proof sheet into said printer and after said leading edge of said proof sheet has passed said printing station to move said print head along said print head axis and across said proof sheet so that said photosensor detects the position of at least one of said side edges of said proof sheet, and said control mechanism is further operable to thereafter cause said print head to print a graphic image onto said proof sheet in accordance with said image data with said printed image being laterally referenced to the position of said one of said side edges of said proof sheet as detected by said photosensor.

5. The combination defined in claim 1, wherein one of said two end portions of said guide roll is fixed against lateral movement relative to said frame along the length of said guide roll axis, and the other of said two end portions of said guide roll is supported for sliding movement along the length of said guide roll axis to vary the spacing between the two sets of sprocket pins carried by said two end portions to accommodate changes in spacing between said two rows of sprocket holes of said proof sheet.

6. The combination defined in claim 1, wherein one of said two end portions of said guide roll is connected with the other of said two end portions of said guide roll through an angular adjustment mechanism permitting one of said two end portions to be adjustably angularly positioned about said guide roll axis relative to the other of said end portions.

7. The combination defined in claim 1, wherein said apparatus further includes a support plate located between said guide roll and said input mouth of said printer for vertically supporting said proof sheet in the space between said guide roll and said input mouth.

8. The combination of an apparatus and a paper proof sheet for use in proofing image data to be used by a photoplotter in raster exposing a graphic image on a photosensitive surface of a sheet of printing plate media, wherein:

said apparatus comprises a raster printer for printing onto said proof sheet a proofing image using said image data so that said proofing image corresponds closely to the image to be exposed on a sheet of printing plate media by a photoplotter using said image data, said raster printer has a frame and a friction sheet advance mechanism for advancing said proof sheet through said printer along a given feed path, said friction sheet advance mechanism having an input mouth with a length dimension extending generally horizontally and perpendicularly to said feed path, an input guide roll is located in advance of said input mouth and mounted for free rotation relative to said frame about a guide roll axis extending generally parallel to said length dimension of said input mouth, said guide roll having two opposite end portions spaced from one another along the length of said guide roll axis, each of said end portions of said guide roll carrying a set of sprocket pins arranged in circumferentially spaced relation to one another about the circumference of the associated end portion, and said proof sheet of paper is of rectangular shape and has a longitudinal axis.

said proof sheet having leading and trailing end edges extending transversely to said longitudinal axis and two s paced side edges extending parallel to said longitudinal axis.

said proof sheet having two lateral marginal portions located respectively adjacent each of said two side edges of said sheet and a leading portion located adjacent said leading edge, and each of said lateral marginal portions of said proof sheet having a row of sprocket holes formed therein and spaced from one another longitudinally of said sheet so that in introducing said proofing sheet to said printer said leading portion of said sheet may first be placed onto said guide roll with the ones of said sprocket holes included in said leading portion being placed on sprocket pins of said two end portions of said guide roll and so that said guide roll may then be rotated manually to move said leading edge of said proof sheet into said mouth of said printer with said sprocket pins of said guide roll and said sprocket holes of said proofing sheet maintaining accurate positioning of said proof sheet relative to said friction sheet advance mechanism of said printer.

said sheet advance mechanism including a main feed roll supported for driven rotation relative to said frame about a feed roll axis generally parallel to said axis of said guide roll, said printer having a horizontally extending output slot spaced above said input mouth and said feed path extends from said input mouth to partially around said feed roll and from said feed roll to said output slot, with the portion of said feed path which passes around said feed roll passing through a printing station, said printer having a generally vertically extending outwardly facing surface between said input mouth and said output slot, a plurality of V-shaped protrusions extend outwardly from said outwardly facing surface and are spaced from one another along the lengths of said input mouth and outlet slot, each of said protrusions having an upper surface extending generally downwardly and outwardly from said output slot and a lower surface extending generally upwardly and outwardly from said input mouth, which upper and lower surfaces intersect to define the outward limit of the protrusion, and at least one of said protrusions having a guide attached to it which guide extends outwardly beyond said outward limit of the associated protrusion to support the portion of said proof sheet which issues from said output slot to inhibit said issuing portion of said proof sheet from re -entering said input mouth and from taking on a cupped shape.

9. The combination defined in claim 8, wherein said guide attached to said at least one protrusion is formed by a first thin strip of flexible material attached to said upper surface of the protrusion and having a portion extending outwardly beyond said outer limit of said protrusion, and a second thin strip of flexible material fixed to said lower surface of said protrusion and having a portion extending outwardly beyond said outer limit of said protrusion, with said outwardly extending portions of said first and second strips engaging one another.

10. The combination defined in claim 9, wherein each of said flexible strips is provided with an adhesive backing layer which secures the strip to said protrusion and which secures said outwardly extending portions of said strips to one another.

11. The combination wherein an apparatus and a paper proof sheet for use in proofing image data to be used by a photoplotter in raster exposing a graphic image on a photosensitive surface of a sheet of printing plate media, wherein:

said apparatus comprises a raster printer for printing onto said proof sheet a proofing image using said image data so that said proofing closely to the image to be closely to the image to be exposed on a sheet of using said image data, said raster printer has a frame and a friction sheet advance mechanism for advancing said proof sheet through said printer along a given feed path, said friction sheet advance mechanism having an input mouth with a length dimension extending generally horizontally and perpendicularly to said feed path, an input guide roll is located in advance of said input mouth and mounted for free rotation relative to said frame about a guide roll axis extending generally parallel to said length dimension of said in put mouth, said guide roll having two opposite end portions spaced from one another along the length of said guide roll axis, each of said end portions of said guide roll carrying a set of sprocket pins arranged in circumferentially spaced relation to one another about the circumference of the associated end portion, and said proof sheet of paper is of rectangular shape and has a longitudinal axis, said proof sheet having leading and trailing end edges extending transversely to said longitudinal axis and two spaced side edges extending parallel to said longitudinal axis, said proof sheet having two lateral marginal portions located respectively adjacent each of said two side edges of said sheet and a leading portion located adjacent said leading edge, and each of said lateral marginal portions of said proof sheet having a row of sprocket holes formed therein and spaced from one another longitudinally of said sheet so that in introducing said proofing sheet to said printer said leading portion of said sheet may first be placed onto said guide roll with the ones of said sprocket holes included in said leading portion being placed on sprocket pins of said two end portions of said guide roll and so that said guide roll may then be rotated manually to move said leading edge of said proof sheet into said mouth of said printer with said sprocket pins of said guide roll and said sprocket holes of said proofing sheet maintaining accurate positioning of said proof sheet relative to said friction sheet advance mechanism of said printer, said sheet advance mechanism including a main feed roll supported for driven rotation relative to said frame about a feed roll axis generally parallel to said axis of said guide roll, said printer having a horizontally extending output slot spaced above said input mouth, and said feed path extends from said input mouth to partially around said feed roll and from said feed roll to said output slot with the portion of said feed path which passes around said feed roll passing through a printing station extending alone the length of said feed roll, said printer including a print head movable over said printing station along a print head axis parallel to said guide roll axis for raster printing onto said proof sheet, said printer including a control mechanism for controlling the operation of said sheet advance mechanism and of said print head, said print head carrying a photosensor including a light emitter for emitting light onto a sensing area fixed relative to said photosensor and a light detector for detecting light reflected from said sensing area said sensing area being positioned so that said photosensor is capable of detecting edges on said proof sheet as relative motion occurs between said photosensor and said proof sheet, said control mechanism being operable during the loading of said proof sheet into said printer and after said leading edge of said proof sheet has passed said printing station to move said print head along said 1 print head axis and across said proof sheet so that said photosensor detects the position of at least one of said side edges of said proof sheet, said control mechanism being further operable to thereafter cause said print head to print a graphic image onto said proof sheet in accordance with said image data with said printed image being laterally referenced to the position of said one of said side edges of said proof sheet as detected by said photosensor, said proof sheet including an index opening in said leading edge portion of said proof sheet adjacent one of said rows of sprocket holes, said index hole having a straight index edge extending perpendicularly to said two side edges of said proof sheet, and said control mechanism further being operable during the loading of said proof sheet into said printer to, before said index opening reaches said printing station, move said print head along said print head axis to bring said photosensor into alignment with the path followed by said index opening as said proof sheet moves along said feed path, thereafter to cause said sheet feed mechanism to advance said proof sheet by an increment sufficient to move said index hole past said sensing area of said photodetector so that said photosensor detects the position of said index edge, and thereafter to cause said print head to print a graphic image onto said proof sheet in accordance with said image data with said printed image being longitudinally referenced to the position of said index edge as detected by said photosensor.

12. The combination defined in claim 11, wherein said control mechanism is further operable to inhibit subsequent printing onto said proof sheet by said print head in the event said photosensor fails to detect said index edge of said index hole during the advancement of said proof sheet through said increment.

13. The combination defined in claim 12, wherein said proof sheet has two oppositely directed faces both of which faces are to be printed upon by said printer during two separate passes, respectively, of said proof sheet through said printer, said printer having a manually settable selector for indicating to said control mechanism which of said two faces of said proof sheet is intended to be printed upon during a given pass of said proof sheet through said printer, and said control mechanism in preparation for the detection of said index edge of said index hole by said photosensor is operable in response to the setting of said selector to position said print head into alignment with the path followed by said index opening as said proof sheet moves along said feed path assuming said proof sheet is moved into said sheet advance mechanism with said leading edge thereof being the actual leading edge and with said sheet oriented about said longitudinal axis so that the one of said major faces which will be printed upon agrees with the setting of said selector.

14. The combination of an apparatus and a paper proof sheet for use in proofing image data to be used by a photoplotter in raster ex posing a graphic image on a photosensitive surface of a sheet of printing plate media, wherein:

said apparatus comprises a raster printer for printing onto said proof sheet a proofing image using said image data so that said proofing image corresponds closely to the image to be exposed on a sheet of printing plate media by a photoplotter using said image data, said raster printer has a frame and a friction sheet advance mechanism for advancing said proof sheet through said printer along a given feed path, said friction sheet advance mechanism having an in put mouth with a length dimension extending generally horizontally and perpendicularly to said feed path, an input guide roll is located in advance of said input mouth and mounted for free rotation relative to said frame about a guide roll axis extending generally parallel to said length dimension of said input mouth, said guide roll having two opposite end portions spaced from one another along the length of said guide roll axis, and each of said end portions of said guide roll carrying a set of sprocket pins arranged in circumferentially spaced relation to one another about the circumference of the associated end portion, and said proof sheet of paper is of rectangular shape and has a longitudinal axis, said proof sheet having leading and trailing end edges extending transversely to said longitudinal axis and two s paced side edges extending parallel to said longitudinal axis, said proof sheet having two lateral marginal portions located respectively adjacent each of said two side edges of said sheet and a leading portion located adjacent said leading edge, and each of said lateral marginal portions of said proof sheet having a row of sprocket holes formed therein and spaced from one another longitudinally of said sheet so that in introducing said proofing sheet to said printer said leading portion of said sheet may first be placed onto said guide roll with the ones of said sprocket holes included in said leading portion being placed on sprocket pins of said two end portions of said guide roll and so that said guide roll may then be rotated manually to move said leading edge of said proof sheet into said mouth of said printer with said sprocket pins of said guide roll and said sprocket holes of said proofing sheet maintaining accurate positioning of said proof sheet relative to said friction sheet advance mechanism of said printer, one of said two end portions of said guide roll being connected with the other of said two end portions of said guide roll through an angular adjustment mechanism permitting one of said two end portions to be adjustable angularly positioned about said guide roll axis relative to the other of said end portions said angular adjustment mechanism including a worm gear centered on said axis of said guide roll and angularly fixed to one of said end portions of said guide roll and a worm carried by said other one of said end portions of said guide roll and meshing with said worm gear so that by rotation of said worm the angular position of said two end portions relative to one another about said guide roll axis may be adjusted in either angular direction depending on the direction of rotation of said worm.

15. The combination of an apparatus and a paper proof sheet for use in proofing image data to be used by a photoplotter in raster exposing a graphic image on a photosensitive surface of a sheet of printing plate media, wherein:

said apparatus comprises a raster printer for printing onto said proof sheet a proofing image using said image data so that said proofing image corresponds closely to the image to be exposed on a sheet of printing plate media by a photoplotter using said image data, said raster printer has a frame and a friction sheet advance mechanism for advancing said proof sheet through said printer along a given feed path, said friction sheet advance mechanism having an input mouth with a length dimension extending generally horizontally and perpendicularly to said feed path, an input guide roll is located in advance of said input mouth and mounted for free rotation relative to said frame about a guide roll axis extending generally parallel to said length dimension of said input mouth, said guide roll having two opposite end portions spaced from one another alone the length of said guide roll axis, each of said end portions of said guide roll carrying a set of sprocket pins arranged in circumferentially spaced relation to one another about the circumference of the associated end portion, and said proof sheet of paper is of rectangular shape and has a longitudinal axis, said proof sheet having leading and trailing end edges extending transversely to said longitudinal axis and two spaced side edges extending parallel to said longitudinal axis.

said proof sheet having two lateral marginal portions located respectively adjacent each of said two side edges of said sheet and a leading portion located adjacent said leading edge.

each of said lateral marginal portions of said proof sheet having a row of sprocket holes formed therein and spaced from one another longitudinally of said sheet so that in introducing said proofing sheet to said printer said leading portion of said sheet may first be placed onto said guide roll with the ones of said sprocket holes included in said leading portion being placed on sprocket pins of said two end portions of said guide roll and so that said guide roll may then be rotated manually to move said leading edge of said proof sheet into said mouth of said printer with said sprocket pins of said guide roll and said sprocket holes of said proofing sheet maintaining accurate positioning of said proof sheet relative to said friction sheet advance mechanism of said printer.

a biasing means associated with said guide roll which biasing means is manually shiftable between active and inactive conditions, said biasing means in said active condition exerting a force on said guide roll tending to resist rotation of said guide roll about said guide roll axis in the direction corresponding to movement of said proof sheet into said input mouth of said printer, and said biasing means in said inactive condition exerting no force on said guide roll resisting its rotation in either direction about said guide roll axis.

16. The combination defined in claim 15, wherein said biasing means associated with said guide roll comprises a biasing roll positioned adjacent and generally parallel to said guide roll, which biasing roll is located on the far side of said guide roll from said input mouth and extends along the length of said guide roll and has two opposite end portions, and two support brackets for said biasing roll fixed relative to said frame adjacent said opposite end portions of said biasing roll, each of said support brackets having a guide slot receiving the associated end portion of said biasing roll, said two slots of said two brackets being similarly shaped and each having an upper portion and a lower portion, said upper portions of said two slots being so shaped and arranged that when said biasing bar is manually moved to bring its end portions into said upper portions of said slots said brackets hold said biasing bar in spaced relation to said guide roll to form a gap between said guide roll and said biasing bar through which gap said proof sheet may be moved in loading said proof sheet onto said guide roll, and said lower portions of said guide slots being so shaped and arranged as to extend downwardly from said upper portions of the slots and toward said guide roll so that when said biasing bar is manually shifted to move its end portions from said upper portions of said slots to said lower portions of said slots said guide bar by its own weight is moved downwardly and into engagement with said guide roll and exerts a force on said guide roll tending to resist rotation of said guide roll about said guide roll axis in the direction corresponding to movement of said proof sheet into said input mouth.

17. The combination of an apparatus and a paper proof sheet for use in proofing image data to be used by a photoplotter in raster exposing a graphic image on a photosensitive surface of a sheet of printing plate media, wherein:

said apparatus comprises a raster printer for printing onto said proof sheet a proofing image using said image data so that said proofing image corresponds closely to the image to be exposed on a sheet of printing plate media by a photoplotter using said image data, said raster printer has a frame and a friction sheet advance mechanism for advancing said proof sheet through said printer along a given feed path, said friction sheet advance mechanism having an input mouth with a length dimension extending generally horizontally and perpendicularly to said feed path, an input guide roll is located in advance of said input mouth and mounted for free rotation relative to said frame about a guide roll axis extending generally parallel to said length dimension of said input mouth, said guide roll having two opposite end portions spaced from one another along the length of said guide roll axis, each of said end portions of said guide roll carrying a set of sprocket pins arranged in circumferentially spaced relation to one another about the circumference of the associated end portion, and said proof sheet of paper is of rectangular shape and has a longitudinal axis, said proof sheet having leading and trailing end edges extending transversely to said longitudinal axis and two spaced side edges extending parallel to said longitudinal axis, said proof sheet having two lateral marginal portions located respectively adjacent each of said two side edges of said sheet and a leading portion located adjacent said leading edge each of said lateral marginal portions of said proof sheet having a row of sprocket holes formed therein and spaced from one another longitudinally of said sheet so that in introducing said proofing sheet to said printer said leading portion of said sheet may first be placed onto said guide roll with the ones of said sprocket holes included in said leading portion being placed on sprocket pins of said two end portions of said guide roll and so that said guide roll may then be rotated manually to move said leading edge of said proof sheet into said mouth of said printer with said sprocket pins of said guide roll and said sprocket holes of said proofing sheet maintaining accurate positioning of said proof sheet relative to said friction sheet advance mechanism of said printer, each of said lateral marginal portions of said proof sheet said sprocket holes being arranged to form groups of regularly spaced regular sprocket holes, which groups of regularly spaced regular sprocket holes are spaced from one another along the length of said proof sheet by indicator zones with each of said indicator zones including one or more indicator sprocket holes visually distinguishable from said regular sprocket holes of said regularly spaced groups of regular sprocket holes, the sprocket hole arrangement appearing in one of said lateral marginal portions being identical to the sprocket hole arrangement appearing in the other of said lateral marginal portions of said proof sheet with each sprocket hole of one lateral marginal portion having a corresponding sprocket hole in the other of said lateral marginal portions which corresponding sprocket holes are located on a common line extending perpendicularly to said side edges of said proof sheet, and said sprocket pins on each of said end portions of said guide roll being arranged in a pattern corresponding to that of said sprocket holes in said lateral marginal portions of said proof sheet so that some of said sprocket pins on each end portion of said guide roll are regular pins and at least one other of the sprocket pins is an indicator pin visually distinguishable from said regular pins so that, in the placing of said proof sheet onto said guide roll, by placing indicator sprocket holes of said proof sheet onto corresponding indicator sprocket pins of said two guide roll end portions misloading of said sheet onto said guide roll in a skewed condition is avoided.

18. The combination defined in claim 17, wherein said one or more indicator sprocket holes in each of said indicator zones is distinguishable from said regular sprocket holes by virtue of said one or more indicator sprocket holes creating an interruption in the regular spacing of the sprocket holes in said lateral marginal portion of said proof sheet.

19. The combination of an apparatus and a paper proof sheet for use in proofing image data to be used by a photoplotter in raster exposing a graphic image on a photosensitive surface of a sheet of printing plate media, wherein:

said apparatus comprises a raster printer for printing onto said proof sheet a proofing image using said image data so that said proofing image corresponds closely to the image to be exposed on a sheet of printing plate media by a photoplotter using said image data, said raster printer has a frame and a friction sheet advance mechanism for advancing said proof sheet through said printer along a given feed path, said friction sheet advance mechanism having an input mouth with a length dimension extending generally horizontally and perpendicularly to said feed path, an input guide roll is located in advance of said input mouth and mounted for free rotation relative to said frame about a guide roll axis extending generally parallel to said length dimension of said input mouth, said guide roll having two opposite end portions spaced from one another along the length of said guide roll axis, each of said end portions of said guide roll carrying a set of sprocket pins arranged in circumferentially spaced relation to one another about the circumference of the associated end portion, and said proof sheet of paper is of rectangular shape and has a longitudinal axis, said proof sheet having leading and trailing end edges extending transversely to said longitudinal axis and two spaced side edges extending parallel to said longitudinal axis, said proof sheet having two lateral marginal portions located respectively adjacent each of said two side edges of said sheet and a leading portion located adjacent said leading edge, each of said lateral marginal portions of said proof sheet having a row of sprocket holes formed therein and spaced from one another longitudinally of said sheet so that in introducing said proofing sheet to said printer said leading portion of said sheet may first be placed onto said guide roll with the ones of said sprocket holes included in said leading portion being placed on sprocket pins of said two end portions of said guide roll and so that said huide roll may then be rotated manually to move said leading edge of said proof sheet into said mouth of said printer with said sprocket pins of said guide roll and said sprocket holes of said proofing sheet maintaining accurate positioning of said proof sheet relative to said friction sheet advance mechanism of said printer.

two bails are carried by said frame and located respectively adjacent each of said end portions of said guide roll, each of said bails including a bail body movable relative to said frame between opened and closed positions, said bail body carrying a hold down wheel having an axis of rotation relative to said bail body and two tire portions spaced from one another along the length of said axis of rotation, said hold down wheel being so arranged and supported on said bail body that when said bail body is in said closed position said hold down wheel has its axis of rotation arranged paralled to said guide roll axis and has its two tire portions located on opposite sides of the associated set of said sprocket pins so as to hold said proof sheet onto said sprocket pins, said bail body and said hold down wheel when in said bail body is in said open position being removed from said associated set of sprocket pins to permit loading of said proof sheet onto said sprocket pins.

20. A raster printer for printing onto a receiving sheet, said printer comprising:

a frame, a friction sheet advance mechanism for advancing a receiving sheet through said printer along a given feed path, said friction sheet advance mechanism having an input mouth with a length dimension extending generally horizontally and perpendicularly to said feed path, said sheet advance mechanism including a main feed roll supported for driven rotation relative to said frame about a feed roll axis extending generally parallel to said input mouth, said printer having a horizontally extending output slot spaced above said input mouth, and said feed path extending from said input mouth to partially around said feed roll and from said feed roll to said output slot, said printer having a generally vertically extending outwardly facing surface between said input mouth and said output slot, a plurality of V-shaped protrusions extending outwardly from said outwardly facing surface and spaced from one another along the lengths of said input mouth and output slot, each of said protrusions having an upper surface extending generally downwardly and outwardly from said output slot and a lower surface extending generally upwardly and outwardly from said input mouth, which upper and lower surfaces intersect to define the outward limit of the protrusion, and at least one of said protrusions having a guide attached to it which guide extends outwardly beyond said outward limit of the associated protrusion to support the portion of said receiving sheet which issues from said output mouth to inhibit said issuing portion of said receiving sheet from re-entering said input mouth and from taking a cupped shape.

21. The printer defined in claim 20, wherein said guide attached to said at least one protrusion is formed by a first thin strip of flexible material attached to said upper surface of the protrusion and having a portion extending outwardly beyond said outer limit of said protrusion, and a second thin strip of flexible material fixed to said lower surface of said protrusion and having a portion extending outwardly beyond said outer limit of said protrusion, with said outwardly extending portions of said first and second strips engaging one another.

22. The printer defined in claim 21, wherein each of said flexible strips is provided with an adhesive backing layer which secures the strip to said protrusion and which secures said outwardly extending portions of said strips to one another.

23. A raster printer for printing graphic images onto sheets of receiving material in accordance with image data input into said printer and which receiving sheets are of rectangular shape with each sheet having a longitudinal axis, two parallel side edges, a lateral marginal portion adjacent each of the two side edges, leading and trailing end edges, and a row of sprocket holes in each of the marginal portions, said printer comprising:

a frame, a friction sheet advance mechanism for advancing a receiving sheet through said printer along a given feed path, said friction sheet advance mechanism having an input mouth with a length dimension extending generally horizontally and perpendicularly to said feed path, and an input guide roll located in advance of said input mouth and mounted for free manual rotation independently of said advance mechanism relative to said frame about a guide roll axis extending generally parallel to said length dimension of said input mouth, said guide roll having two opposite end portions spaced from one another along the length of said guide roll axis, each of said end portions of said guide roll carrying a set of sprocket pins arranged in circumferentially spaced relation to one another about the circumference of the associated end portion for receiving the sprocket holes of an associated one of said lateral marginal edge portions of said sheet, said guide roll having an outer cylindrical surface extending substantially continuously between said two opposite end portions and said cylindrical surface having an uppermost part, and means providing a horizontal support surface between said uppermost part of said outer cylindrical surface of said guide roll and said input mouth to vertically support said proof sheet in the area between said guide roll and said input mouth, so that in introducing a receiving sheet to said input mouth of said printer such sheet may be first placed onto said guide roll with ones of said sprocket holes being placed on sprocket pins of said two end portions of said guide roll and so that said guide roll may then be rotated manually to move the receiving sheet into said mouth of said printer with said sprocket pins of said guide roll maintaining accurate positioning of the receiving sheet relative to said friction sheet advance mechanism and with said horizontal support surface vertically supporting said proof sheet in the area between said guide roll and said input mouth.

24. A printer as defined in claim 23, wherein said raster printer is an ink jet printer.

25. A printer as defined in claim 23, wherein said sheet advance mechanism includes a main feed roll supported for driven rotation relative to said frame about a feed roll axis generally parallel to said axis of said guide roll.

said printer has a horizontally extending output slot spaced above said input mouth, and said feed path extends from said input mouth to partially around said feed roll and from said feed roll to said output slot with the portion of said feed path which passes around said feed roll passing through a printing station extending along the length of said feed roll, said printer includes a print head movable over said printing station along a print head axis parallel to said guide roll axis for raster printing onto the receiving sheet, said printer includes a control mechanism for controlling the operation of said sheet advance mechanism and of said print head, said print head carries a photosensor including a light emitter for emitting light onto a sensing area fixed relative to said photosensor and a light detector for detecting light reflected from said sensing area, said sensing area being positioned so that said photosensor is capable of detecting edges on a receiving sheet as relative motion occurs between said photosensor and the sheet, said control mechanism is operable during the loading of a receiving sheet into said printer and after said leading edge of the sheet has passed said printing station to move said print head along said print head axis and across the sheet so that said photosensor detects the position of at least one of the side edges of the sheet, and said control mechanism is further operable to thereafter cause said print head to print a graphic image onto said receiving sheet in accordance with said image data with said printed image being laterally referenced to the position of said one of the side edges of the sheet as detected by said photosensor.

26. A printer as defined in claim 23, wherein one of said two end portions of said guide roll is fixed against lateral movement relative to said frame along the length of said guide roll axis, and the other of said two end portions of said guide roll is supported for sliding movement along the length of said guide roll axis to vary the spacing between the two sets of sprocket pins carried by said two end portions to accommodate changes in spacing between said two rows of sprocket holes of a receiving sheet.

27. A printer as defined in claim 23, wherein one of said two end portions of said guide roll is connected with the other of said two end portions of said guide roll through an angular adjustment mechanism permitting one of said two end portions to be adjustably angularly positioned about said guide roll axis relative to the other of said end portions.

28. A printer as defined in claim 23, wherein said printer further includes a support plate located between said guide roll and said input mouth for vertically supporting a receiving sheet in the space between said guide roll and said input mouth.

29. A raster printer for printing graphic images onto sheets of receiving material in accordance with image data input into said printer and which receiving sheets are of rectangular shape with each sheet having a longitudinal axis. two parallel side edges, a lateral marginal portion adjacent each of the two side edges, leading and trailing end edges, a row of sprocket holes in each of the marginal portions and an index opening located near said leading edge and adjacent one of said rows of sprocket holes, said index hole having a straight index edge extending perpendicularly to said two side edges of said proof sheet,said printer comprising:

a frame, a friction sheet advance mechanism for advancing a receiving sheet through said printer along a given feed path, said friction sheet advance mechanism having an input mouth with a length dimension extending generally horizontally and perpendicularly to said feed path, and an input guide roll located in advance of said input mouth and mounted for free rotation relative to said frame about a guide roll axis extending generally parallel to said length dimension of said input mouth.

said guide roll having two opposite end portions spaced from one another along the length of said guide roll axis, and each of said end portions of said guide roll carrying a set of sprocket pins arranged in circumferentially spaced relation to one another about the circumference of the associated end portion for receiving the sprocket holes of an associated one of said lateral marginal edge portions of said sheet, so that in introducing a receiving sheet to said input mouth of said printer such sheet may be first placed onto said guide roll with ones of said sprocket holes being placed on sprocket pins of said two end portions of said guide roll and so that said guide roll may then be rotated manually to move the receiving sheet into said mouth of said printer with said sprocket pins of said guide roll maintaining accurate positioning of the receiving sheet relative to said friction sheet advance mechanism, said control mechanism further being operable during the loading of a receiving sheet into said printer to, before said index opening reaches said printing station, move said print head along said print head axis to bring said photosensor into alignment with the path followed by said index opening as a receiving sheet moves along said feed path, thereafter to cause said feed mechanism to advance said receiving sheet by an increment sufficient to move said index hole past said sensing area of said photodetector so that said photosensor detects the position of said index edge, and thereafter to cause said print head to print a graphic image onto said receiving sheet in accordance with said image data with said printed image being longitudinally referenced to the position of said index edge as detected by said photosensor.

30. A printer as defined in claim 29, for use with receiving sheets each having two main oppositely directed faces both of which faces are to be printed upon by said printer during two separate passes, respectively, of a sheet through said printer, wherein said printer has a manually settable selector for indicating to said control mechanism which of said two faces of a receiving sheet is intended to be printed upon during a given pass of the sheet through said printer, and said control mechanism in preparation for the detection of said index edge of said index hole by said photosensor is operable in response to the setting of said selector to position said print head into alignment with the path followed by said index opening as a receiving sheet moves along said feed path assuming said sheet is moved into said sheet advance mechanism with said leading edge thereof being the actual leading edge and with said sheet oriented about said longitudinal axis so that the one of said major faces which will be printed upon agrees with the setting of said selector.

31. A raster printer for printing graphic images onto sheets of receiving material in accordance with image data input into said printer and which receiving sheets are of rectangular shape with each sheet having a longitudinal axis, two parallel side edges, a lateral marginal portion adjacent each of the two side edges, leading and trailing end edges, and a row of sprocket holes in each of the marginal portions, said printer comprising:

a frame, a friction sheet advance mechanism for advancing a receiving sheet through said printer along a given feed path, said friction sheet advance mechanism having an input mouth with a length dimension extending generally horizontally and perpendicularly to said feed path, an input guide roll located in advance of said input mouth and mounted for free rotation relative to said frame about a guide roll axis extending generally parallel to said length dimension of said input mouth.

said guide roll having two opposite end portions spaced from one another along the length of said guide roll axis, and each of said end portions of said guide roll carrying a set of sprocket pins arranged in circumferentially spaced relation to one another about the circumference of the associated end portion for receiving the sprocket holes of an associated one of said lateral marginal edge portions of said sheet, so that in introducing a receiving sheet to said in put mouth of said printer such sheet may be first placed onto said guide roll with ones of said sprocket holes being placed on sprocket pins of said two end portions of said guide roll and so that said guide roll may then be rotated manually to move the receiving sheet into said mouth of said printer with said sprocket pins of said guide roll maintaining accurate positioning of the receiving sheet relative to said friction sheet advance mechanism.

said printer further including a biasing means associated with said guide roll which biasing means is manually shiftable between active and inactive conditions, said biasing means in said active condition exerting a force on said guide roll tending to resist rotation of said guide roll about said guide roll axis in the direction corresponding to movement of said proof sheet into said input mouth of said printer, and said biasing means in said inactive condition exerting no force on said guide roll resisting its rotation in either direction about said guide roll axis.

32. A printer as defined in claim 31, wherein said biasing means associated with said guide roll comprises a biasing roll positioned adjacent and generally parallel to said guide roll, which biasing roll is located on the far side of said guide roll from said input mouth and extends along the length of said guide roll and has two opposite end portions, and two support brackets for said biasing roll fixed relative to said frame adjacent said opposite end portions of said biasing roll, each of said support brackets having a guide slot receiving the associated end portion of said biasing roll, said two slots of said two brackets being similarly shaped and each having an upper portion and a lower portion, said upper portions of said two slots being so shaped and arranged that when said biasing bar is manually moved to bring its end portions into said upper portions of said slots said brackets hold said biasing bar in spaced relation to said guide roll to form a gap between said guide roll and said biasing bar through which gap said proof sheet may be moved in loading said proof sheet onto said guide roll, and said lower portions of said guide slots being so shaped and arranged as to extend downwardly from said upper portions of the slots and toward said guide roll so that when said biasing bar is manually shifted to move its end portions from said upper portions of said slots to said lower portions of said slots said guide bar by its own weight is moved downwardly and into engagement with said guide roll and exerts a force on said guide roll tending to resist rotation of said guide roll about said guide roll axis in the direction corresponding to movement of a receiving sheet into said input mouth.

33. A proof sheet for use with a raster printer for the printing of graphic images onto one or both of its faces by the printer in response to image data, said proof sheet being of rectangular shape and having a longitudinal axis, said sheet having leading and trailing end edges extending transversely to said longitudinal axis and two spaced side edges extending parallel to said longitudinal axis, said sheet having two lateral marginal portions located respectively adjacent each of two side edges of said sheet and a leading portion located adjacent said leading edge, each of said lateral marginal portions of said sheet having a row of sprocket holes formed therein and spaced from one another longitudinally of said sheet, and said sheet having an index hole in said leading edge portion which index hole is spaced perpendicularly of said sheet from both of said rows of sprocket holes so as to be out of alignment with either of said rows of sprocket holes and which index hole includes a straight index edge extending perpendicularly to said side edges of said sheet.

34. A proof sheet as defined in claim 33, wherein said index hole is located adjacent to and laterally inboard of one of said two rows of sprocket holes in said lateral marginal portions of said sheet.

35. A proof sheet as defined in claim 33, wherein in each of said rows of sprocket holes in said lateral marginal portions of said proof sheet said sprocket holes are arranged so as to form groups of regularly spaced regular sprocket holes, which groups of regularly spaced regular sprocket holes are spaced from one another along the length of said proof sheet by indicator zones with each of said indicator zones including one or more indicator sprocket holes visually distinguishable from said regular sprocket holes of said regularly spaced groups of regular sprocket holes, the sprocket hole arrangement appearing in one of said lateral marginal portions being identical to the sprocket hole arrangement appearing in the other of said lateral marginal portions of said proof sheet with each sprocket hole of one lateral marginal portion having a corresponding sprocket hole in the other of said lateral marginal portions which corresponding sprocket holes are located on a common line extending perpendicularly to said side edges of said proof sheet.

36. A proof sheet as defined in claim 35, wherein said one or more indicator sprocket holes in each of said indicator zones is distinguishable from said regular sprocket holes by virtue of said one or more indicator holes creating an interruption in the regular spacing of the sprocket holes in the associated lateral marginal portion of said proof sheet.

37. An apparatus for working on sheets of sheet material which sheets are of rectangular shape with each sheet having a longitudinal axis, two parallel side edges, a lateral marginal portion adjacent each of the two side edges, leading and trailing end edges, and a row of sprocket holes in each of the marginal portions, said apparatus comprising:

a frame, a friction sheet advance mechanism for advancing a sheet through said apparatus along a given feed path, said friction sheet advance mechanism having an input mouth with a length dimension extending generally horizontally and perpendicularly to said feed path, an input guide roll located in advance of said input mouth and mounted for free manual rotation independently of said advance mechanism relative to said frame about a guide roll axis extending generally parallel to said length dimension of said input mouth, said guide roll having two opposite end portions spaced from one another along the length of said guide roll axis, and each of said end portions of said guide roll carrying a set of sprocket pins arranged in circumferentially spaced relation to one another about the circumference of the associated end portion for receiving the sprocket holes of an associated one of said lateral marginal edge portions of said sheet, said guide roll having an outer cylindrical surface extending substantially continuously between said two opposite end portions and said cylindrical surface having an uppermost part, and means providing a horizontal support surface between said uppermost part of said outer cylindrical surface of said guide roll and said input mouth to vertically support said proof sheet in the area between said guide roll and said input mouth, so that in introducing a sheet to said input mouth of said printer such sheet may be first placed onto said guide roll with ones of said sprocket holes being placed on sprocket pins of said two end portions of said guide roll and so that said guide roll may then be rotated manually to move the sheet into said mouth of said printer with said sprocket pins of said guide roll maintaining accurate positioning of the sheet relative to said friction sheet advance mechanism and with said horizontal support surface vertically supporting said proof sheet in the area between said guide roll and said input mouth.

* * * * *

UNITED STATES PATENT AND TRADEMARK OFFICE

CERTIFICATE OF CORRECTION

PATENT NO. : 5,810,494

DATED : September 22, 1998

INVENTOR(S) : Alan W. Menard, Robert V. DeMartino, John E. Markowski, III, Nabil Mishriki, Ronald G. Goulet, William J. Tortora It is certified that error appears in the above-identified patent and that said Letters Patent is hereby corrected as shown below:

Claim 8, Column 15, line 22, change "s paced" to --spaced--.
Claim 8, Column 16, line 4, change "re -entering" to --re-entering--.
Claim 11, Column 16, line 21, delete "wherein" and insert --of --.
Claim 11, Column 16, line 28, after "proofing", insert --image corresponds--, and after "closely", delete "to the image to be closely".
Claim 11, Column 16, line 29, after "sheet of", insert --printing plate media by a photoplotter--.
Claim 11, Column 16, line 40, change "in put" to --input--.
Claim 11, Column 17, line 34, after "along said", delete "l".
Claim 14, Column 18, line 28, change "ex posing" to --exposing--.
Claim 14, Column 18, line 35, after "image data", "said raster" should be the start of a new paragraph.
Claim 14, Column 18, line 39, change "in put" to --input--.
Claim 14, Column 18, line 41, "an input guide roll is" should be the start of a new paragraph.
Claim 14, Column 18, line 48, after "axis", delete "and".
Claim 14, Column 18, line 58, change "s paced" to --spaced--.
Claim 14, Column 18, line 63, after "leading edge", delete "and".
Claim 14, Column 19, line 17, after "end portions", insert --,--.
Claim 15, Column 19, line 61, after "axis", delete "." and insert --,--.
Claim 15, Column 19, line 65, after "edge", delete "." and insert --,--.
Claim 15, Column 20, line 13, after "printer", delete "." and insert --,--.
Claim 17, Column 21, line 25, after "edge", insert --,--.

UNITED STATES PATENT AND TRADEMARK OFFICE

CERTIFICATE OF CORRECTION

PATENT NO. : 5,810,494

DATED : September 22, 1998

INVENTOR(S) : Alan W. Menard, RObert V. DeMartino, John E. Markowski, III, Nabil Mishriki, Ronald G. Goulet, William J. Tortora It is certified that error appears in the above-identified patent and that said Letters Patent is hereby corrected as shown below:

Claim 19, Column 22, line 58, change "huide" to --guide--.
Claim 25, Column 24, line 56, after "roll", delete "." and insert --,--.
Claim 29, Column 25, line 49, after "axis", delete "." and insert --,--.

Signed and Sealed this

Twenty-third Day of March, 1999

*Attest:*

Q. TODD DICKINSON

*Attesting Officer*

*Acting Commissioner of Patents and Trademarks*